US012448190B2

(12) United States Patent
Merzeau et al.

(10) Patent No.: US 12,448,190 B2
(45) Date of Patent: Oct. 21, 2025

(54) ARTICLE CARRIERS AND BLANKS THEREFOR

(71) Applicant: WestRock Packaging Systems, LLC, Atlanta, GA (US)

(72) Inventors: Julien D. Merzeau, Châteauroux (FR); Gabriel Fernandes Pine, Zamudio (ES); Matthew E. Zacherle, Chesterfiled, VA (US); Vincent Fahrner, Chateauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 18/560,571

(22) PCT Filed: May 13, 2022

(86) PCT No.: PCT/US2022/029126

§ 371 (c)(1),
(2) Date: Nov. 13, 2023

(87) PCT Pub. No.: WO2022/241179

PCT Pub. Date: Nov. 17, 2022

(65) Prior Publication Data

US 2024/0253882 A1 Aug. 1, 2024

Related U.S. Application Data

(60) Provisional application No. 63/188,159, filed on May 13, 2021.

(51) Int. Cl.
*B65D 71/42* (2006.01)

(52) U.S. Cl.
CPC ..... *B65D 71/42* (2013.01); *B65D 2571/0066* (2013.01)

(58) Field of Classification Search
CPC ..... B65D 71/40; B65D 71/42; B65D 71/44; B65D 2571/0066
(Continued)

(56) References Cited

U.S. PATENT DOCUMENTS 10,836,550 B2 * 11/2020 Zacherle ..... B65D 71/44
2018/0222650 A1 8/2018 Zacherle

FOREIGN PATENT DOCUMENTS

EP 2067713 A1 6/2009
WO WO2019222341 A1 11/2019
WO 2020210562 A1 10/2020

OTHER PUBLICATIONS

WO2022241179 International Search Report dated Nov. 17, 2022.
EP Office Action dtd Jul. 25, 2025, 4 pgs.

* cited by examiner

*Primary Examiner* — Bryon P Gehman
(74) *Attorney, Agent, or Firm* — Brian J. Goldberg; Tsugihiko Suzuki; Rohini K. Garg

(57) ABSTRACT

Aspects of the disclosure relate to article carriers (90) for forming a package and blanks (10; 110; 210; 310; 410; 510) for forming the article carriers (90). The blank (10; 110; 210; 310; 410; 510) comprises at least one panel (12) having at least one article engaging structure (RT1, RT2). The at least one article engaging structure (RT1, RT2) comprises an article receiving aperture (AP) and an annular series of tabs (14A, 14B, 14C, 14D) formed around the article receiving aperture (AP). The annular series of tabs (14A, 14B, 14C, 14D) is defined at least in part by plurality of radial cut lines (15A, 15B). The annular series of tabs (14A, 14B, 14C, 14D) is defined at least in part by plurality of circumferential cut lines (9A, 9B, 11). The annular series of tabs (14A, 14B, 14C, 14D) comprises at least one first tab (14A) having a first folding resistance and at least one second tab (14B, 14C,
(Continued)

14D) having a second folding resistance, the second fold resistance being lower than the first fold resistance.

22 Claims, 7 Drawing Sheets

(58) Field of Classification Search
USPC ..... 206/147–153
See application file for complete search history.

ARTICLE CARRIERS AND BLANKS THEREFOR

The present application is a 35 U.S.C. §§ 371 national stage application of PCT/US2022/29126 filed on 13 May 2022, which claims the benefit of priority to U.S. Provisional Patent Application Ser. No. 63/188,159 filed on 13 May 2021, the contents of each of which are incorporated herein by reference in their entirety.

TECHNICAL FIELD

The present invention relates to packages, to article carriers, and to blanks for forming the same. More specifically, but not exclusively, the invention relates to a package comprising a carrier having a main panel including one or more apertures for receiving an article.

BACKGROUND

In the field of packaging, it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting a weight of grouped articles. It is desirable that the contents of the carton are securely held by the carton and that the cartons or carriers are easy for a consumer to grasp and carry.

It is an object of the present disclosure to provide an article carrier for substantially cylindrical articles having a minimalistic appearance and having improved article retention and/or reduced deformation.

The present invention seeks to provide an improvement in the field of cartons, typically formed from paperboard or the like.

SUMMARY

A first aspect of the invention provides an article carrier for packaging at least one article. The article carrier comprises a main panel with openings for receiving at least one article. The openings comprise an article receiving aperture and an annular series of tabs formed around the article receiving aperture. The annular series of tabs comprises at least one first tab having a first folding resistance and at least one second tab having a second folding resistance. The second fold resistance is lower than the first fold resistance.

Advantageously, providing tabs with higher relative fold resistance in selected areas of the main panel (for example, but not limited to, providing tabs with higher fold resistance in interior or central regions of the main panel than tabs located about exterior or marginal regions) may improve or facilitate folding of the exterior tabs and may reduce undesired or unsightly deformation of given regions main panel, (for example, but not limited to, exterior or marginal regions of the main panel).

Optionally, the at least one first tab and the at least one second tab each comprise an angular width, the angular width of the first tab is equal to the angular width of the second tab and the second tab comprises a hinged connection to the main panel having a greater number of weakening elements than a hinged connection between the at least one first tab and the main panel.

Optionally, the at least one first tab comprises a first hinged connection to the main panel having at least one connecting bridge, the at least one first connecting bridge having a first total length, the at least one second tab comprises a second hinged connection to the main panel having at least one second connecting bridge, the at least one second connecting bridge has a second total length, the second total or combined length is less than the first total or combined length.

Optionally, the second hinged connection to the main panel comprises a plurality of second connecting bridges, the plurality of second connecting bridges has a combined second length, the combined second length is less than the first total length.

Optionally, the at least one first tab is an inner tooth, disposed about an interior region of the article receiving aperture.

Optionally, the at least one second tab is an outer tooth, disposed about an exterior region of the article receiving aperture.

Optionally, the outer tooth is diametrically opposed to the inner tooth.

Optionally, the inner tooth is disposed in closer proximity to a second article receiving aperture of an adjacently disposed opening or article engaging structure than the outer tooth.

Optionally, the outer tooth may be arranged such that a notional line passes through the center of the opening and a vertex defined by adjacent side and end edges of the main panel is collinear with a side edge of the outer tooth.

Optionally, the main panel comprises a handle opening defined, at least in part, by at least one handle flap hingedly connected to the main panel, the at least one handle flap arranged to fold towards the at least one first tab.

Optionally, the at least one handle flap comprises a first handle flap and a second handle flap hingedly connected to the main panel by respective hinged connections, the first handle flap folds towards the at least one first tab of a first opening in the main panel and the second handle flap folds towards the at least one first tab of a second opening in the main panel.

Optionally, the at least one article receiving aperture is a corner aperture, and the at least one first and second tabs are defined by radial cutlines, the radial cut line of a second tab is positioned across from the respective corner of the main panel such that the radial cut line extends from the corner aperture toward the corner of the main panel.

A second aspect of the invention provides an article carrier of the top engaging type for packaging at least one article. The article carrier comprises an engaging panel having at least one article engaging structure. The at least one article engaging structure comprises an article receiving aperture and an annular series of teeth formed around the article receiving aperture. The annular series of teeth comprises a first tooth disposed between a pair of second teeth. Each of the teeth of the annular series of teeth is defined, at least in part, by a pair of T-cuts. The T-cuts are defined by a radial cutline and a first circumferential cutline. The first tooth comprises a second circumferential cutline disposed between an adjacent pair of first circumferential cutlines.

A third aspect of the invention provides an article carrier of the top engaging type for packaging at least one article. The article carrier comprises an engaging panel having at least one article engaging structure. The at least one article engaging structure comprises an article receiving aperture and an annular series of teeth formed around the article receiving aperture. The annular series of teeth comprises a second tooth disposed between a pair of first teeth. Each of the teeth of the annular series of teeth is defined, at least in part, by a pair of T-cuts. The T-cuts are defined by a radial cutline and a first circumferential cutline. The pair of first teeth each comprise a second circumferential cutline disposed between a pair of first circumferential cutlines.

A fourth aspect of the invention provides an article carrier of the top engaging type for packaging at least one article. The article carrier comprises an engaging panel having at least two article engaging structures. Each of the at least two article engaging structures comprises an article receiving aperture and an annular series of teeth disposed around the article receiving aperture. Each of the teeth of the annular series of teeth is defined, at least in part, by a pair of T-cuts. The T-cuts are defined by a radial cutline and a first circumferential cutline. The annular series of teeth of a first one of the at least two article engaging structures comprises a first tooth disposed adjacent to at least one second tooth. The annular series of teeth of a second one of the at least two article engaging structures comprises a first tooth disposed adjacent to at least one second tooth. The first tooth of each of the first and second article engaging structures comprises a second circumferential cutline disposed between a pair of first circumferential cutlines. The first tooth of the first one of the at least two article engaging structures is bisected by a notional line passing through the center of the article receiving aperture of the first one of the at least two article engaging structures. The notional line passes through the center of the article receiving aperture of the second one of the at least two article engaging structures and bisects the first tooth of the second one of the at least two article engaging structures.

A fifth aspect of the invention provides an article carrier of the top engaging type for packaging at least one article. The article carrier comprises an engaging panel having at least two article engaging structures. Each of the at least two article engaging structures comprises an article receiving aperture and an annular series of teeth formed around the article receiving aperture. Each of the teeth is defined, at least in part, by a pair of T-cuts. The T-cuts comprise a radial cutline and a first circumferential cutline. The annular series of teeth of a first one of the at least two article engaging structures comprises a pair of first teeth separated by first T-cut. The annular series of teeth of a second one of the at least two article engaging structures comprises at least one second tooth. The at least one second tooth comprises a second circumferential cutline disposed between a pair of first circumferential cutlines. The second circumferential cutline of a second tooth is disposed opposite the T-cut separating the pair of first teeth.

Optionally, a notional line passing through the center of the article receiving aperture of the first one of the at least two article engaging structures and the center of the article receiving aperture of the second one of the at least two article engaging structures bisects said second tooth and its respective second circumferential cutline, the notional line is collinear with a radial portion of the first T-cut, and bisects a first circumferential cutline of the first T-cut.

A sixth aspect of the invention provides a blank for forming an article carrier. The blank comprises a main panel with openings for receiving at least one article. The openings comprise an article receiving aperture and an annular series of tabs formed around the article receiving aperture. The annular series of tabs comprises at least one first tab having a first folding resistance and at least one second tab having a second folding resistance. The second fold resistance is lower than the first fold resistance.

A seventh aspect of the invention provides a blank for forming an article carrier. The blank comprises an engaging panel having at least one article engaging structure. The at least one article engaging structure comprises an article receiving aperture and an annular series of teeth formed around the article receiving aperture. The annular series of teeth comprises a first tooth disposed between a pair of second teeth. Each of the teeth of the annular series of teeth is defined, at least in part, by a pair of T-cuts. The T-cuts are defined by a radial cutline and a first circumferential cutline. The first tooth comprises a second circumferential cutline disposed between an adjacent pair of first circumferential cutlines.

An eighth aspect of the invention provides a blank for forming an article carrier. The blank comprises an engaging panel having at least one article engaging structure. The at least one article engaging structure comprises an article receiving aperture and an annular series of teeth formed around the article receiving aperture. The annular series of teeth comprises a second tooth disposed between a pair of first teeth. Each of the teeth of the annular series of teeth is defined, at least in part, by a pair of T-cuts. The T-cuts are defined by a radial cutline and a first circumferential cutline. The pair of first teeth each comprise a second circumferential cutline disposed between a pair of first circumferential cutlines.

A ninth aspect of the invention provides a blank for forming an article carrier. The blank comprises an engaging panel having at least two article engaging structures. Each of the at least two article engaging structures comprises an article receiving aperture and an annular series of teeth disposed around the article receiving aperture. Each of the teeth of the annular series of teeth is defined, at least in part, by a pair of T-cuts. The T-cuts are defined by a radial cutline and a first circumferential cutline. The annular series of teeth of a first one of the at least two article engaging structures comprises a first tooth disposed adjacent to at least one second tooth. The annular series of teeth of a second one of the at least two article engaging structures comprises a first tooth disposed adjacent to at least one second tooth. The first tooth of each of the first and second article engaging structures comprises a second circumferential cutline disposed between a pair of first circumferential cutlines. The first tooth of the first one of the at least two article engaging structures is bisected by a notional line passing through the center of the article receiving aperture of the first one of the at least two article engaging structures. The notional line passes through the center of the article receiving aperture of the second one of the at least two article engaging structures and bisects the first tooth of the second one of the at least two article engaging structures.

A tenth aspect of the invention provides a blank for forming an article carrier. The blank comprises an engaging panel having at least two article engaging structures. Each of the at least two article engaging structures comprises an article receiving aperture and an annular series of teeth formed around the article receiving aperture. Each of the teeth is defined, at least in part, by a pair of T-cuts. The T-cuts comprise a radial cutline and a first circumferential cutline. The annular series of teeth of a first one of the at least two article engaging structures comprises a pair of first teeth separated by first T-cut. The annular series of teeth of a second one of the at least two article engaging structures comprises at least one second tooth. The at least one second tooth comprises a second circumferential cutline disposed between a pair of first circumferential cutlines. The second circumferential cutline of a second tooth is disposed opposite the T-cut separating the pair of first teeth.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the packages, blanks, and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks, and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
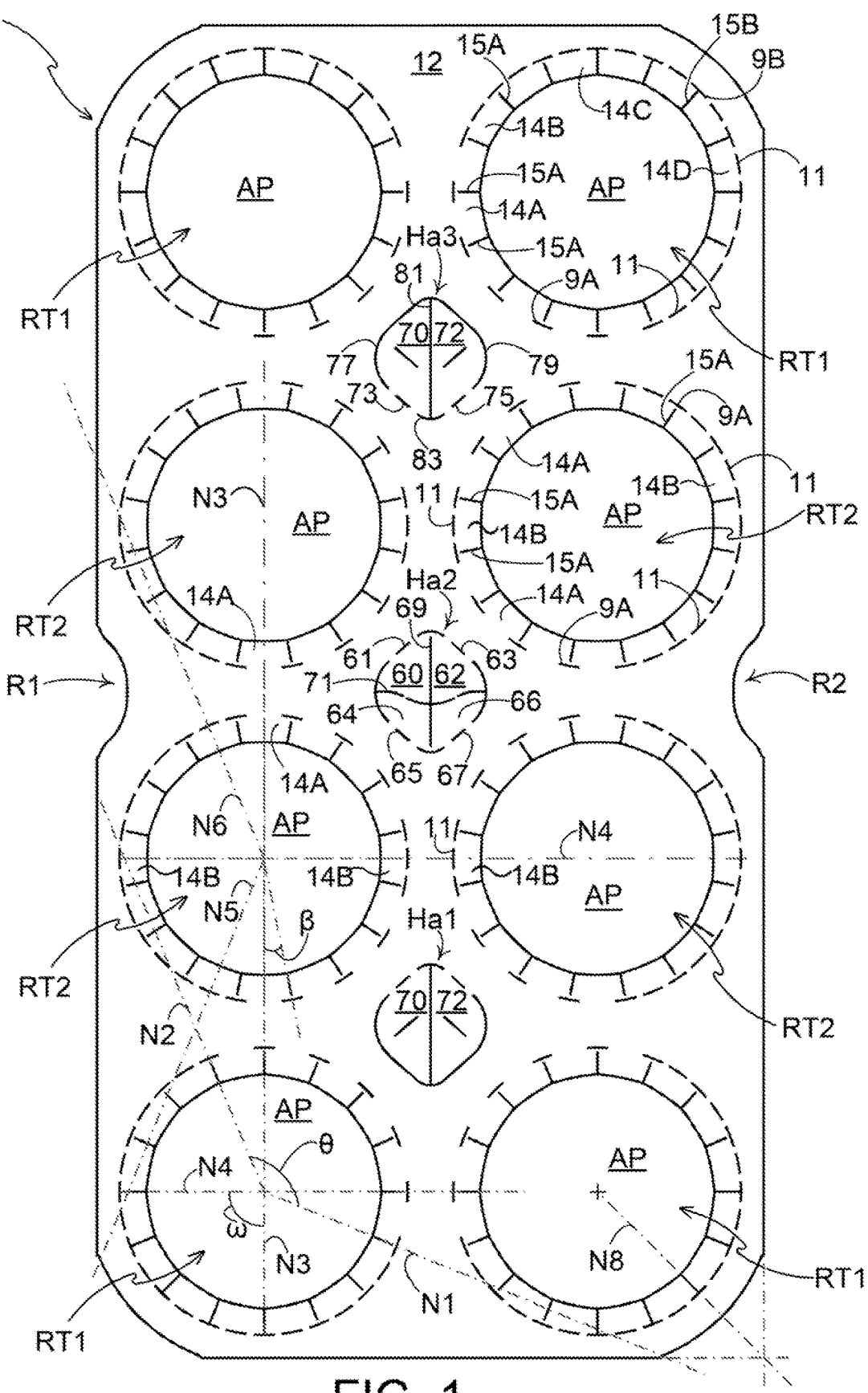
FIG. 1 is a plan view from above of a blank for forming an article carrier according to a first embodiment.
Figure 2:
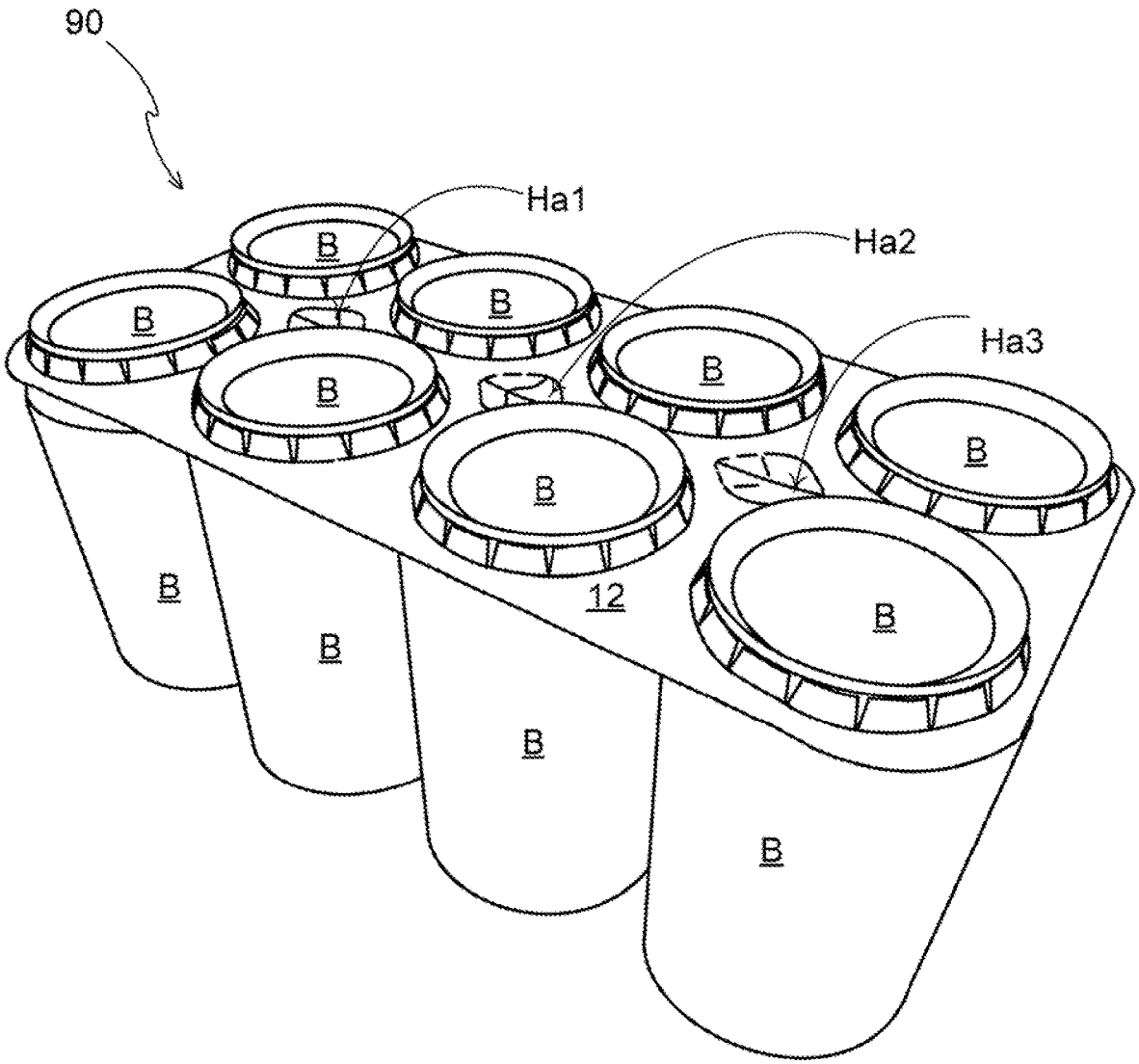
FIG. 2 is a perspective view from above of an article carrier formed from the blank of FIG. 1.

Referring to FIG. 1, there is shown a plan view of a blank 10 which is capable of forming a carton or carrier 90, as shown in FIG. 2. The carrier 90 is suitable for containing and carrying a group of primary products such as, but not limited to, bottles or cans, hereinafter referred to as articles B. The blank 10 forms a secondary package 90 that packages at least one primary product container B. Alternative blanks 110; 210; 310; 410; 510 are shown in FIGS. 3 to 7 respectively for forming an alternative carton or carrier (not shown).

In the embodiments detailed herein, the terms "carton" and "carrier" refer, for the non-limiting purpose of illustrating the various features of the invention, to a container for engaging and carrying articles, such as primary product containers (articles B). It is contemplated that the teachings of the invention can be applied to various product containers, which may or may not be tapered and/or cylindrical. Exemplary containers may include bottles (for example metallic, glass or plastics bottles), cans (for example aluminum cans), tins, pouches, packets and the like.

The blanks 10; 110; 210; 310; 410; 510 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure 90 described in more detail below.

The packaging structures or cartons 90, described herein, may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110; 210; 310; 410; 510 are configured to form a carton or carrier 90 for packaging an exemplary arrangement of exemplary articles B. In the embodiments illustrated, the arrangement is a 4×2 matrix or array. In the illustrated embodiments four rows of two articles are provided, and the articles B are beverage cans. Alternatively, the blanks 10; 110; 210; 310; 410; 510 can be configured to form a carrier for packaging other types, number and size of articles and/or for packaging articles in a different arrangement or configuration.

FIG. 1 illustrates a first embodiment and shows the blank 10 for forming the article carrier 90 shown in FIG. 2. The carrier 90 takes the form of a top gripping clip. The article carrier 90 comprises openings configured to receive the articles B. The openings are arranged to accommodate a neck or upper portion of an article B, above a main body and/or shoulders of the article B.

The blank 10 comprises a main or engaging panel 12. The main panel 12 of the blank 10 includes at least one article retention structure RT1, RT2. The main panel 12 comprises a plurality of article retention structures RT1, RT2, specifically eight article retention structures RT1, RT2 arranged in 2×4 matrix or array. Each of the article retention structures RT1, RT2 comprises an article receiving aperture AP about which a plurality of teeth or tabs 14A, 14B, 14C, 14D may be disposed. Each of the teeth 14A, 14B, 14C, 14D is struck from the engaging panel 12 and is hingedly connected thereto. Each tooth 14A, 14B, 14C, 14D may be defined, in part, by a pair of cut lines 15A, 15B. The cut lines 15A, 15B extend generally radially outward from a center of the article receiving aperture AP. The teeth or tabs 14A, 14B, 14C, 14D are arranged in an annular series about the article receiving aperture AP to form part of an article receiving opening.

The plurality of teeth 14A, 14B, 14C, 14D are provided by the main panel 12. Each of the teeth 14A, 14B, 14C, 14D is hingedly connected to the main panel 12, by a hinged connection. The hinged connection may be defined by a plurality of cut lines 9A, 9B, 11. The plurality of cut lines 9A, 9B, 11 may be arranged as an annular series of cuts about the article receiving aperture AP.

The plurality of cut lines 9A, 9B, 11 may define or approximate a portion of circle.

The blank 10 comprises four endmost article retention structures RT1 each comprising an article receiving aperture AP. The blank 10 comprises four medial or intermediate article retention structures RT2 each comprising an article receiving aperture AP.

The endmost article retention structures RT1 comprise an article receiving opening defined in part by the article receiving aperture AP which is defined in, or struck from, the main panel 12.

The intermediate article retention structures RT2 comprise an article receiving opening defined in part by the article receiving aperture AP which is defined in, or struck from, the main panel 12.

It is desirable to provide the article retention structures RT1, RT2 with teeth 14A, 14B, 14C, 14D having different folding resistance. It has been found that providing teeth 14A, 14B, 14C, 14D about inner regions of the article receiving aperture AP (portions of the article receiving aperture AP disposed medially of the main panel 12) with a hinged connection having an increased folding resistance facilitates folding of the teeth 14A, 14B, 14C, 14D about outer regions of the article receiving aperture AP (portions of the article receiving aperture AP proximate the side or end edges of the main panel 12). It is believed that this arrangement of teeth 14A, 14B, 14C, 14D may concentrate or focus stress or forces on those teeth 14A, 14B, 14C, 14D proximate the side or end edges of the main panel 12 (also referred to herein as outer teeth) when an article B is inserted into the article receiving opening.

The article retention structures RT1, RT2 comprise annular series of teeth of varied folding resistances wherein the folding resistance of one or more teeth proximate the outer perimeter of the blank 10 is less than that of one or more teeth located further from the perimeter of the blank 10.

The endmost article retention structures RT1 comprise a first plurality of teeth or tabs 14A, 14B, 14C, 14D disposed about the article receiving aperture AP, best shown in FIG. 1. Each of the first plurality of teeth 14A, 14B, 14C, 14D comprises an engaging edge opposing a hinged edge. The engaging edges are defined by a portion of a cut line defining the article receiving aperture AP, said portion of the cut line defining the article receiving aperture AP may be linear. Each engaging edge may define a part of a polygon. The illustrated embodiment comprises sixteen teeth 14A, 14B, 14C, 14D together defining a substantial portion of hexadecagon. The endmost article retention structures RT1 comprise six first teeth 14A, four second teeth 14B, two third teeth 14C, and four fourth teeth 14D. Each of the first n second, third, and fourth teeth 14A, 14B, 14C, 14D may occupy substantially the same circumferential region or portion of the article receiving aperture AP. Each tooth 14A, 14B, 14C, 14D comprises a pair of side edges, the side edges are defined by cuts 15A, 15B extending radially outward from respective vertices of the hexadecagon forming the article receiving aperture AP, that is to say, from a respective vertex between a pair of adjacent linear portions of the cut defining the portion of a hexadecagon. The cuts 15A, 15B are divergently arranged with respect to each other and define an angle therebetween, the angle may be about 22.5°. Each tooth 14A, 14B, 14C, 14D disposed about the article receiving aperture AP has the same angular width as the other teeth 14A, 14B, 14C, 14D; the engaging edges of the teeth 14A, 14B, 14C, 14D are of equal length.

The endmost article retention structures RT1 comprise a plurality of first circumferential cut lines 9A. Each of the plurality of first circumferential cut lines 9A is aligned with one of a first radial cut lines 15A such that said one of the first radial cut lines 15A or a notional extension thereof bisects a respective one of the plurality of first circumferential cut lines 9A.

Each of the radial cut lines 15A is spaced apart from a corresponding one of the plurality of first circumferential cut lines 9A. Each first radial cut line 15A is arranged with respect to one of the plurality of first circumferential cut lines 9A so as to bisect first circumferential cut lines 9A. In this way a connecting nick or bridge portion is provided between a pair of adjacently disposed teeth 14A, 14B, 14C sharing a common first radial cut line 15A. The first radial cut lines 15A and first circumferential cut lines 9A define disconnected T-shaped cuts.

Each of the plurality of first circumferential cut lines 9A may be linear in shape.

Each of the plurality of first circumferential cut lines 9A is substantially the same length, that is to say the occupy an equal portion of the perimeter of the article receiving opening.

The endmost article retention structures RT1 comprise a plurality of second circumferential cut lines 9B. Each of the plurality of second circumferential cut lines 9B is aligned with one of a second radial cut lines 15B such that said one of the second radial cut lines 15B bisects a respective one of the plurality of second circumferential cut lines 9B. The second radial cut lines 15A and second circumferential cut lines 9B define a connected T-shaped cut. A pair of adjacently disposed teeth 14C, 14D sharing a common second radial cut line 15B are separated from each other.

Each of the plurality of second circumferential cut lines 9B may be linear in shape.

Each of the plurality of second circumferential cut lines 9B is substantially the same length, that is to say the occupy an equal portion of the perimeter of the article receiving opening.

The second circumferential cut lines 9B may be substantially the same length as the first circumferential cut lines 9A, that is to say the occupy an equal portion of the perimeter of the article receiving opening.

The endmost article retention structures RT1 comprise a plurality of third circumferential cut lines 11. Each of the plurality of third circumferential cut lines 11 is disposed between a pair of the plurality of first or second circumferential cut lines 9A, 9B and is spaced apart therefrom so as to define a pair of connecting nick or bridge portions between each second, third, and fourth tooth 14B, 14C, 14D and the main panel 12. The pair of connecting nick or bridge portions provide a hinged or foldable connection between each second, third, and fourth tooth 14B, 14C, 14D and the main panel 12.

Each of the plurality of third circumferential cut lines 11 may be linear in shape.

The third circumferential cut lines 11 have the effect of reducing the length of unbroken or uninterrupted material, disposed between a pair of first or second circumferential cut lines 9A, 9B, connecting the second teeth 14B to the main panel 12. The first teeth 14A are connected to the main panel 12 by a connecting bridge which is greater in length than the combined or cumulative length of the connecting bridges or nicks connecting the second, third and fourth teeth 14B, 14C, 14D to the main panel 12.

Since less substrate material connects the second teeth 14B to the main panel 12 the second teeth have a lower resistance to folding, that is to say the force required to fold the second teeth 14B is lower than that required to fold the first teeth 14A.

In alternative embodiments, each of the plurality of first circumferential cut lines 9A may be arcuate or curved. In some embodiments, each of the plurality of second circumferential cut lines 9B may be arcuate or curved. In various embodiments, each of the plurality of third circumferential cut lines 11 may be arcuate or curved.

The endmost article retention structures RT1 comprise a plurality of first teeth 14A extending about or occupying a first arc. The first arc defines a sector which subtends a first angle θ. The first angle θ may be about 135° or equivalent to six teeth 14A, 14B, 14C, 14D. Each first tooth 14A comprises, or is defined by, a pair of first radial cutlines 15A and a pair of first circumferential cutlines 9A. The first sector is defined by, between, a first notional line N1 and a second notional line N2, neither of the first and second notional lines N1, N2 passes through the article receiving aperture AP of the adjacently disposed article retention structures RT1, RT2. That is say the first notional line N1 does not pass through or intersect the article receiving aperture AP of the adjacently disposed endmost article retention structure RT1. The second notional line N2 does not pass through or intersect the article receiving aperture AP of the adjacently disposed intermediate article retention structure RT2.

The endmost article retention structures RT1 comprise a plurality of fourth teeth 14D extending about or occupying a second arc. The second arc defines a sector which subtends a second angle ω. The second angle ω may be about 90° or equivalent to four teeth 14A, 14B, 14C, 14D. Each fourth tooth 14D comprises, or is defined by, a pair of second radial cutlines 15B, a pair of second circumferential cutlines 9B, and at least one third circumferential cutline 11. In the illustrated embodiment, each fourth tooth 14D comprises, or is defined by, a single third circumferential cutline 11. In alternative embodiments more than one third circumferential cutline 11 may define a hinged connection between the fourth tooth 14D and the main panel 12. The second sector is defined by, between, a third notional line N3 and a fourth notional line N4 each passing through the center of the aperture AP of the respective article retention structure. The third notional line N3 passes through and intersects perpendicularly with an end edge of the main panel 12. The fourth notional line N4 passes through and intersects perpendicularly with a side edge of the main panel 12.

The third notional line N3 may be coincident or colinear with a radial cut 15B of a connected T-cut 15B/9B. The fourth notional line N4 may be coincident or colinear with a radial cut 15B of a connected T-cut 15B/9B.

The endmost article retention structures RT1 comprise a plurality of second teeth 14B arranged in two discrete groups each extending about, or occupying, third and fourth arcs respectively. The third and fourth arcs define a respective sector which subtends a third angle. The third angle may be about 45° or equivalent to two teeth 14A, 14B, 14C, 14D. Each second tooth 14B comprises, or is defined by, a pair of first radial cutlines 15A and a pair of first circumferential cutlines 9A. In the illustrated embodiment, the first arc or sector is disposed between third and fourth arcs or sectors.

The endmost article retention structures RT1 comprise a plurality of third teeth 14C arranged in two discrete groups each extending about, or occupying, fifth and sixth arcs respectively. The fifth and sixth arcs define a respective sector which subtends a fourth angle. The fourth angle may be about 22.5° or equivalent to one tooth 14A, 14B, 14C, 14D. Each third tooth 14C comprises, or is defined by, a first radial cutline 15A, a first circumferential cutline 9A, a second radial cutline 15B, and a second circumferential cutline 9B, and at least one third circumferential cutline 11. In the illustrated embodiment, each third tooth 14C comprises, or is defined by, a single third circumferential cutline 11. In alternative embodiments, more than one third circumferential cutline 11 may define a hinged connection between the third tooth 14C and the main panel 12. In the illustrated embodiment, the second arc or sector is disposed between fifth and sixth arcs or sectors.

Each of the fifth and sixth arcs or sectors is disposed between the second arc or sector and one of the third and fourth arcs or sectors.

The intermediate article retention structures RT2 comprise a second plurality of teeth or tabs 14A, 14B disposed about the article receiving aperture AP. Each of the second plurality of teeth 14A, 14B comprises an engaging edge opposing a hinged edge. The engaging edges are defined by a portion of a cut line defining the article receiving aperture AP, said portion of the cut line defining the article receiving aperture AP may be linear. Each engaging edge may define a part of a polygon. The illustrated embodiment comprises sixteen teeth 14A, 14B together defining a substantial portion of hexadecagon. The intermediate article retention structures RT2 comprise eight first teeth 14A and eight second teeth 14B. Each of the first and second teeth 14A, 14B may occupy substantially the same circumferential region or portion of the article receiving aperture AP. Each tooth 14A, 14B comprises a pair of side edges, the side edges are defined by cuts 15A extending radially outward from respective vertices of the hexadecagon forming the article receiving aperture AP, that is to say, from a respective vertex between a pair of adjacent linear portions of the cut defining the portion of a hexadecagon. The cuts 15A are divergently arranged with respect to each other and define an angle therebetween, the angle may be about 22.5°.

The intermediate article retention structures RT2 comprise a plurality of first circumferential cut lines 9A. Each of the plurality of first circumferential cut lines 9A is aligned with one of a first radial cut lines 15A such that said one of the first radial cut lines 15A or a notional extension thereof bisects a respective one of the plurality of first circumferential cut lines 9A.

Each of the radial cut lines 15A is spaced apart from a corresponding one of the plurality of first circumferential cut lines 9A. Each first radial cut line 15A is arranged with respect to one of the plurality of first circumferential cut lines 9A so as to bisect first circumferential cut lines 9A. In this way a connecting nick or bridge portion is provided between a pair of adjacently disposed teeth 14A, 14B sharing a common first radial cut line 15A. The first radial cut lines 15A and first circumferential cut lines 9A define disconnected T-shaped cuts.

Each of the plurality of first circumferential cut lines 9A may be linear in shape.

The intermediate article retention structures RT2 comprise a plurality of third circumferential cut lines 11. Each of the plurality of third circumferential cut lines 11 is disposed between a pair of first circumferential cut lines 9A and is spaced apart therefrom so as to define a pair of connecting nick or bridge portions between each second tooth 14B, and the main panel 12. The pair of connecting nick or bridge portions provide a hinged or foldable connection between each second tooth 14B and the main panel 12.

Each of the plurality of third circumferential cut lines 11 may be linear in shape.

In the illustrated embodiment, the intermediate article retention structures RT2 do not comprise any connected T-cuts, the intermediate article retention structures RT2 may comprise connected T-cuts in alternative embodiments.

The intermediate article retention structures RT2 comprise a plurality of first teeth 14A arranged in two discrete groups each extending about, or occupying, first and second arcs respectively. The first and second arcs define a respective sector which subtends a first angle. The first angle may be about 90° or equivalent to four teeth 14A. Each first tooth 14A comprises, or is defined by, a pair of first radial cutlines 15A and a pair of first circumferential cutlines 9A.

The intermediate article retention structures RT2 comprise a plurality of second teeth 14B arranged in two discrete groups each extending about, or occupying, third and fourth arcs respectively. The third and fourth arcs define a respective sector which subtends a second and third angle respectively. The second angle may be about 157.5° or equivalent to seven teeth 14B. The third angle may be about 22.5° or equivalent to one tooth 14B. Each second tooth 14B comprises, or is defined by, a pair of first radial cutlines 15A, a pair of first circumferential cutlines 9A, and at least one third circumferential cutline 11.

In the illustrated embodiment, the third and fourth arcs are disposed on substantially opposing sides of the article receiving aperture AP. A notional line N4 bisecting the third and fourth arcs is substantially perpendicular to the side edge of the main panel 12, that is to say it is transversely oriented.

In the illustrated embodiment, the third arc or sector is disposed between first and second arcs or sectors and faces substantially toward a side edge of the main panel 12.

FIG. 1 illustrates fifth and sixth notional lines N5, N6, fifth and sixth notional lines N5, N6 extend radially from the center of the article receiving aperture AP through the middle of a respective outermost second tooth 14B of defining the third arc or sector. Neither of the fifth and sixth notional lines N5, N6 passes through, or intersects with, the article receiving aperture AP of an adjacently disposed article retention structure RT1, RT2. In this way at least half of each second tooth 14B disposed about the third arc faces substantially away from the article receiving aperture AP of an adjacently disposed article retention structure RT1, RT2.

Each of the second teeth 14B disposed about the third arc can be considered to face substantially toward the proximal free side edge of the main panel 12.

In the illustrated embodiment, the fourth arc or sector is disposed between first and second arcs or sectors and faces substantially toward an adjacently disposed intermediate article retention structures RT2 or medial portion of the main panel 12.

The arrangement of teeth 14A, 14B, the cut pattern of radial cut lines 15A, of the intermediate article retention structures RT2, has been rotated about the center of the article receiving aperture AP with respect, or relative, to the arrangement of teeth 14A, 14B, 14C, 14B, the cut pattern of radial cut lines 15A, 15B, about the article receiving aperture AP of the endmost article retention structures RT1. The endmost article retention structures RT1 are rotated through an angle β with respect to intermediate article retention structures RT2. The angle of rotation β may be about 11.25° or equivalent to half a tooth 14A, 14B, 14C, 14B.

The endmost article retention structures RT1 comprise a firstfirst radial cut line 15A which lies upon a notional line N3 extending longitudinally of the blank 10; said notional line N3 passes through the center of a first tooth 14A of an adjacently disposed intermediate article retention structure RT2.

The endmost article retention structures RT1 comprise a second first radial cut line 15A which lies upon a notional line N4 extending transversely of the blank 10; said notional line N4 is coincident or collinear with a first radial cut line 15A of a first tooth 14A of an adjacently disposed endmost article retention structure RT1.

One of the second radial cut lines 15B lies upon a notional line N8 passing through the center C of the article receiving aperture AP and through a real, or notional, corner of the engaging panel 12; the real or notional corner being defined by the intersection of a pair of notional lines collinear with a respective one of the end and side edges of the main panel 12.

The endmost article retention structures RT1 comprise a first second radial cut line 15B which lies upon a notional line N3 extending longitudinally of the blank 10; said first second radial cut line 15B is oriented perpendicular with respect to an end edge of the engaging panel 12 and is parallel to a longitudinal axis of the engaging panel 12.

The endmost article retention structures RT1 comprise a second second radial cut line 15B which lies upon a notional line N4 extending transversely of the blank 10; said second second radial cut line 15B is oriented perpendicular with respect to a side edge of the engaging panel 12 and is perpendicular to the longitudinal axis of the engaging panel 12.

The intermediate article retention structures RT2 comprise a first tooth 14A lying upon a notional line N3 extending longitudinally of the blank 10, the longitudinal notional line N3 bisects the first tooth 14A and bisects a first tooth 14A of an adjacently disposed intermediate article retention structure RT2.

The intermediate article retention structures RT2 comprise a second tooth 14B, defining the fourth arc or sector, and lying upon a notional line N4 extending transversely of the blank 10, the transverse notional line N4 bisects the second tooth 14B (and optionally its third circumferential cutline 11) and also bisects a second tooth 14B (and optionally its respective third circumferential cutline 11) of an adjacently disposed intermediate article retention structure RT2.

In this way a pair of longitudinally adjacent intermediate article retention structures RT2 comprise a pair of first teeth 14A in closest proximity to each other, whereas a pair of transversely adjacent intermediate article retention structures RT2 comprise a pair of second teeth 14B in closest proximity to each other. The first teeth 14A are hinged to the main panel 12 by a hinged connection having a greater fold resistance than the hinged connection hinging the second teeth 14B to the main panel 12. The at least one third cutline 11 may have the effect of reducing the fold resistance. Employing connected T-cuts 15B/9B may also have the effect of reducing the fold resistance.

It has been found that providing a pair of adjacent intermediate article retention structures RT2 having second teeth 14B in closest proximity to each other may improve the retention of the article B within article retention structure RT2.

In the illustrated embodiment, the folding resistance is increased or decreased by the absence or presence of the at least one third cutline 11 and/or selection of connected T-cuts 15B/9B or disconnected T-cuts 15A/9A. In alternative embodiments, the folding resistance may be controlled by employing alternative devices, such as, but not limited to, a score line or adjusting the length of the at least one third cutline 11; shortening the third cutlines 11 increases the length of the connecting bridges or nicks between the teeth 14A, 14B, 14C, 14D and hence the fold resistance.

The blank 10 may comprise a handle structure. The handle structure comprises one, two, three or more handle or finger openings spaced apart from each other.

The handle or finger openings are disposed on a longitudinal axis bisecting the engaging panel 12.

A first opening Ha1 is provided between a first group of four article retention structures RT1, RT2. The first group of four article retention structures RT1, RT2 is provided adjacent a first end of the engaging panel 12. The first opening Ha1 is disposed between a first row of endmost article retention structures RT1 and a second row of intermediate article retention structures RT2. The first opening Ha1 is located at the center of the first group of four article retention structures RT1, RT2.

A second opening Ha2 is provided between a second group of four article retention structures RT2. The second group of four article retention structures RT2 is provided medially of the engaging panel 12. The second opening Ha2 is disposed between the second row of intermediate article retention structures RT2 and a third row of intermediate article retention structures RT2. The second opening Ha2 is located at the center C of the second group of four article retention structures RT2.

A third opening Ha3 is provided between a third group of four article retention structures RT1, RT2. The third group of four article retention structures RT1, RT2 is provided adjacent a second end of the engaging panel 12. The third opening Ha3 is disposed between the third row of intermediate article retention structures RT2 and a fourth row of endmost article retention structures RT1. The third opening Ha3 is located at the center of the third group of four article retention structures RT1, RT2.

The first, second and third openings Ha1, Ha2, Ha3 lie, at least in part, between a first column of article retention structures RT1, RT2 and a second column of article retention structures RT1, RT2.

The first, second and third openings Ha1, Ha2, Ha3 are generally surrounded or in closest proximity to first teeth 14A of the article retention structures RT1, RT2, this may be advantageous for increased the strength, resilience, or integrity of the main panel 12 when the handle structure is employed by a user.

Each of the handle openings Ha1, Ha2, Ha3 is defined by a plurality of tabs 60, 62, 64, 66, 70, 72. The first and third handle openings Ha1, Ha3 are substantially similar in construction to each other albeit a mirror image thereof.

The first and third handle openings Ha1, Ha3 comprises two tabs 70, 72. Each tab 70, 72 is hinged to the engaging panel 12 by a hinged connection in the form of a fold line 73, 75. A first tab 70 is separated from a second tab 72 by a first cut line or severable line 81. Each of the first and second tabs 70, 72 may comprises a fold line, the fold line may be defined in part by a cut; the cut may be arranged to be spaced apart from the respective fold line 73, 75 hinging the first and second tabs 70, 72 to the engaging panel 12 and may optionally be parallel thereto. Each of the first and second tabs 70, 72 may be defined in part by a generally V-shaped cut line 77, 79.

The first and second tabs 70, 72 of each of the first and third handle openings Ha1, Ha3 are arranged to fold generally towards the middle of the main panel 12. The first tabs 70 fold towards one of the intermediate article retention structures RT2 in a first column, the second tabs 72 fold towards one of the intermediate article retention structures RT2 in a second column.

Each of the handle openings Ha1, Ha2, Ha3 is substantially rhombus or diamond shaped, in other embodiments other shapes may be employed such as, but not limited to square.

The second handle opening Ha2 comprises four tabs 60, 62, 64, 66. Each tab 60, 62, 64, 66 is hinged to the engaging panel 12 by a hinged connection in the form of a fold line 61, 63, 65, 67. An arcuate or curvilinear cut line may be provided between pairs of fold lines 61, 63, 65, 67 to define a corner or vertex of the handle opening Ha2. The second handle opening Ha2 comprises a pair of major tabs 60, 62 and a pair of minor tabs 64, 66.

A first major tab 60 is separated from a second major tab 62 by a first cut line or severable line 69. A first minor tab 64 is separated from a second minor tab 66 by the first cut line or severable line 69.

The first and second minor tabs 64, 66 are separated from the first and second major tabs 60, 62 by a second cut line or severable line 71.

The first cut line 69 is colinear with a notional line passing though the center C of the group of four intermediate article retention structures RT2.

The first cut line 69 may be linear in shape and may extend between a first pair of opposed vertices of the handle opening Ha1, Ha2, Ha3.

The second cut line 71 may be non-linear in shape and may extend between a second pair of opposed vertices of the handle opening Ha1, Ha2, Ha3. The second cut line 71 intersects the first cutline 69, the second cut line 71 comprises an inverted "V" shaped medial portion; a vertex of the "V" shaped portion intersects the first cutline 69.

The first major tab 60 is hinged to the engaging panel 12 by a first fold line 61. The second major tab 62 is hinged to the engaging panel 12 by a second fold line 63.

The first minor tab 64 is hinged to the engaging panel 12 by a third fold line 65. The second minor tab 66 is hinged to the engaging panel 12 by a fourth fold line 67.

The first fold line 61 is divergently arranged with respect to the second fold line 63.

The first fold line 61 is divergently arranged with respect to the third fold line 65.

The second fold line 63 is divergently arranged with respect to the fourth fold line 67.

The third fold line 65 is divergently arranged with respect to the fourth fold line 67.

The first and second major tabs 60, 62 of the second handle opening Ha2 are arranged to fold towards one of the intermediate article retention structures RT2 in the second row of article retention structures RT1, RT2, the first and second minor tabs 64, 66 of the second handle opening Ha2 are arranged to fold towards one of the intermediate article retention structures RT2 in the third row of article retention structures RT1, RT2.

Optionally, the blank 10 comprises a first recess or cutaway R1 struck from a first side edge (see FIG. 1). The first finger recess or cutaway R1 lies upon a notional line extending laterally of the blank 10 and bisecting the blank 10. In this way the first finger recess or cutaway R1 lies between the second and third rows of article retention structures RT2.

Optionally, the blank 10 comprises a second finger recess or cutaway R2 struck from a second side edge. The second side edge opposes the first side edge. The second finger recess or cutaway R2 lies upon a notional line extending laterally of the blank 10 and bisecting the blank 10. In this way the second finger recess or cutaway R2 lies between the second and third rows of article retention structures RT2.

The second handle opening Ha2 is collinear with the first and second finger recesses R1, R2.

The blank 10 forms a carrier 90, the blank 10 is lowered with respect to a group of articles B. Each opening of the retention structures RT1, RT2 receives one of the articles B forming the group. An end closure or upper end of the articles B passes through the openings. The tabs 14A, 14B, 14C, 14D fold out of the plane of the engaging panel 12. The tabs 14A, 14B, 14C, 14D fold upwardly, the tabs 14A, 14B, 14C, 14D engage an article B below a flange or projection extending radially outward from the neck of the article B. The tabs 14A, 14B, 14C, 14D support the article B and inhibit movement or withdrawal of the article B from the opening, best shown in FIG. 2.

The connected T-cuts 15B/9B provided by the second radial cut lines 15B and second circumferential cut lines 9B reduce stress in the corner region of the main panel 12. The absence of connecting portions between the fourth teeth 14D has been found to reduce the likelihood of tear propagation in the main panel 12.

The connecting nicks between first, second, and third teeth 14B, 14C, 14D may increase the security of the article B within the article receiving structures RT1, RT2, and may increase biasing of the tabs 14B, 14C, 14D against the article B so as to improve article retention.

Referring now to FIGS. 3 to 7, there is shown an additional embodiment of the present disclosure. In the second, third, fourth, and fifth illustrated embodiment like numerals have, where possible, been used to denote like parts, albeit with the addition of the prefix "100", "200", "300", "400", "500" to indicate that these features belong to the second, third, fourth, and fifth embodiments respectively. The additional embodiments share many common features with the first embodiment and therefore only the differences from the embodiment illustrated in FIGS. 1 and 2 will be described in detail.

Figure 3:
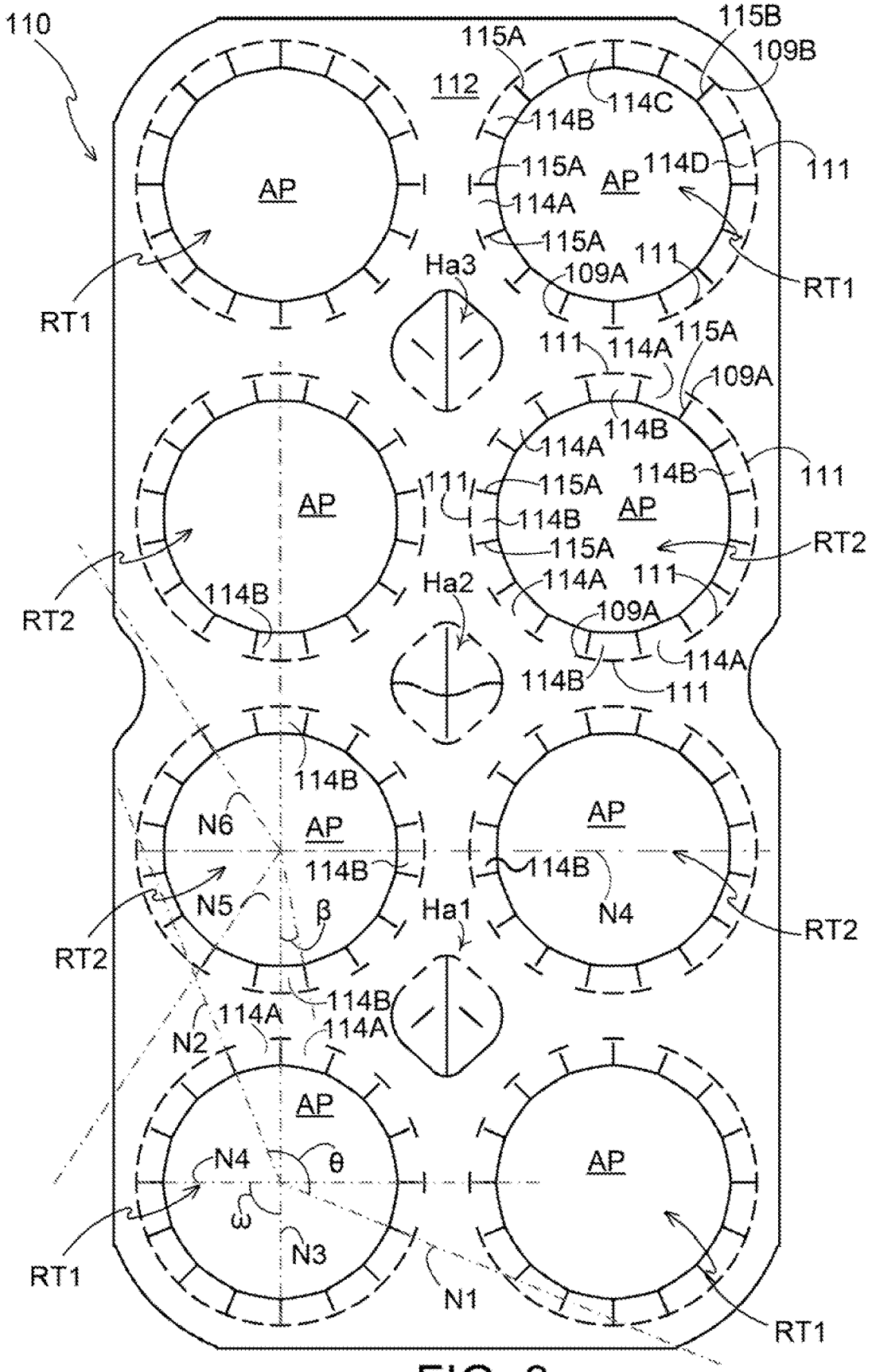
FIG. 3 is a plan view from above of a blank for forming an article carrier according to a second embodiment.

FIG. 3 illustrates a second embodiment and shows a blank 110 for forming an article carrier (not shown).

The blank 110 comprises an engaging panel 112. The engaging panel 112 of the blank 110 includes at least one article retention structure RT1, RT2, each retention structure RT1, RT2 provides an article receiving aperture AP for receiving a respective article. The engaging panel 112 comprises a plurality of article retention structures RT1, RT2, specifically eight article retention structures RT1, RT2 arranged in 2×4 matrix or array. Each of the article retention structures RT1, RT2 comprises an opening or aperture AP about which a plurality of teeth or tabs 114A, 114B, 114C, 114D may be disposed. Each of the teeth 114A, 114B, 114C, 114D is struck from the engaging panel 112 and is hingedly connected thereto. Each tooth 114A, 114B, 114C, 114D may be defined, in part, by a pair of cut lines 115A, 115B. The cut lines 115A, 115B extend radially outward from a center of the article receiving aperture AP1, AP2. The teeth or tabs 114A, 114B, 114C, 114D are arranged in an annular series about the article receiving aperture AP to form part of an article receiving opening.

The plurality of teeth 114A, 114B, 114C, 114D are provided by the main panel 112. Each of the teeth 114A, 114B, 114C, 114D is hingedly connected to the main panel 112, by a hinged connection. The hinged connection may be defined by a plurality of cut lines 109A, 109B, 111. The plurality of cut lines 109A, 109B, 111 may be arranged as an annular series of cuts about the article receiving aperture AP.

The plurality of cut lines 109A, 109B, 111 may define or approximate a portion of circle.

The blank 110 comprises four endmost article retention structures RT1 each comprising an article receiving aperture AP. The blank 110 comprises four medial or intermediate article retention structures RT2 each comprising an article receiving aperture AP.

The endmost article retention structures RT1 comprise an article receiving opening defined in part by the article receiving aperture AP which is defined in, or struck from, the main panel 112.

The intermediate article retention structures RT2 comprise an article receiving opening defined in part by the article receiving aperture AP which is defined in, or struck from, the main panel 112.

The article retention structures RT1, RT2 comprise annular series of teeth of varied folding resistances wherein the folding resistance of one or more teeth proximate the outer perimeter of the blank 110 is generally less than that of one or more teeth located further from the perimeter of the blank 110.

The endmost article retention structures RT1 are substantially the same in construction as the endmost article retention structures RT1 described in the previous embodiment and/or as illustrated in FIG. 1.

The intermediate article retention structures RT2 comprise a second plurality of teeth or tabs 114A, 114B disposed about the article receiving aperture AP. Each of the second plurality of teeth 114A, 114B comprises an engaging edge opposing a hinged edge. The engaging edges are defined by a portion of a cut line defining the article receiving aperture AP, said portion of the cut line defining the article receiving aperture AP may be linear. Each engaging edge may define a part of a polygon. The illustrated embodiment comprises sixteen teeth 114A, 114B together defining a substantial portion of hexadecagon. The intermediate article retention structures RT2 comprise eight first teeth 114A and eight second teeth 114B. Each of the first and second teeth 114A, 114B may occupy substantially the same circumferential region or portion of the article receiving aperture AP. Each tooth 114A, 114B comprises a pair of side edges, the side edges are defined by cuts 115A extending radially outward from respective vertices of the hexadecagon forming the article receiving aperture AP, that is to say, from a respective vertex between a pair of adjacent linear portions of the cut defining the portion of a hexadecagon. The cuts 115A are divergently arranged with respect to each other and define an angle therebetween, the angle may be about 22.5°.

The intermediate article retention structures RT2 comprise a plurality of first circumferential cut lines 109A. Each of the plurality of first circumferential cut lines 109A is aligned with one of a first radial cut lines 115A such that said one of the first radial cut lines 115A or a notional extension thereof bisects a respective one of the plurality of first circumferential cut lines 109A.

Each of the radial cut lines 115A is spaced apart from a corresponding one of the plurality of first circumferential cut lines 109A. Each first radial cut line 115A is arranged with respect to one of the plurality of first circumferential cut lines 109A so as to bisect first circumferential cut lines 109A. In this way a connecting nick or bridge portion is provided between a pair of adjacently disposed teeth 114A, 114B sharing a common first radial cut line 115A. The first radial cut lines 115A and first circumferential cut lines 109A define disconnected T-shaped cuts.

Each of the plurality of first circumferential cut lines 109A may be linear in shape.

The intermediate article retention structures RT2 comprise a plurality of third circumferential cut lines 111. Each of the plurality of third circumferential cut lines 111 is disposed between a pair of first circumferential cut lines 109A and is spaced apart therefrom so as to define a pair of connecting nick or bridge portions between each second tooth 114B, and the main panel 112. The pair of connecting nick or bridge portions provide a hinged or foldable connection between each second tooth 114B and the main panel 112.

Each of the plurality of third circumferential cut lines 111 may be linear in shape.

In the illustrated embodiment, the intermediate article retention structures RT2 do not comprise any connected T-cuts, the intermediate article retention structures RT2 may comprise connected T-cuts in alternative embodiments.

The intermediate article retention structures RT2 comprise a plurality of first teeth 114A arranged in four discrete groups each extending about, or occupying, first, second, third, and fourth arcs respectively. The first and second arcs define a respective sector which subtends a first angle. The first angle may be about 67.5° or equivalent to three teeth 114A. The third and fourth arcs define a respective sector which subtends a second angle. The second angle may be about 22.5° or equivalent to one tooth 114A. Each first tooth 114A comprises, or is defined by, a pair of first radial cutlines 115A and a pair of first circumferential cutlines 109A.

The intermediate article retention structures RT2 comprise a plurality of second teeth 114B arranged in four discrete groups each extending about, or occupying, fifth, sixth, seventh, and eighth arcs respectively. The fifth arc defines a fifth sector which subtends a fifth angle. The fifth angle may be about 112.5° or equivalent to five teeth 114B. The sixth, seventh, and eighth arcs define a respective sector each of which subtends a sixth angle. The sixth angle may be about 22.5° or equivalent to one tooth 114B. Each second tooth 114B comprises, or is defined by, a pair of first radial cutlines 115A, a pair of first circumferential cutlines 109A, and at least one third circumferential cutline 111. The sixth arc or sector may be arranged generally orthogonally to the seventh and eighth arcs or sectors and opposite the fifth sector or arc.

The sixth, seventh, and eighth arcs comprise a second tooth 114B which is disposed in close proximity to an adjacently disposed article retention structure RT1, RT2. The fifth arc comprise a second tooth 114B which is disposed in closest proximity to a side edge of the main panel 112.

The second tooth 114B of the sixth, seventh, and eighth arcs comprises a third circumferential cut line 111. The third circumferential cut line 111 is aligned to be opposite a third circumferential cut line 111 of an adjacently disposed intermediate article retention structure RT2 or a first circumferential cut line 109A of an adjacently disposed endmost article retention structure RT1.

A notional line N4 bisecting the fifth and sixth arcs is substantially perpendicular to the side edge of the main panel 112, that is to say, it is transversely oriented. A notional line N3 bisecting the seventh and eighth arcs is substantially perpendicular to the end edge of the main panel 112, that is to say, it is longitudinally oriented.

The intermediate article retention structures RT2 comprise a second tooth 114B lying upon a notional line N3 extending longitudinally of the blank 110, the longitudinal notional line N3 bisects the second tooth 114B and bisects a second tooth 114B of an adjacently disposed intermediate article retention structure RT2.

The intermediate article retention structures RT2 comprise a second tooth 114B, defining the sixth arc or sector, and lying upon a notional line N4 extending transversely of the blank 110, the transverse notional line N4 bisects the second tooth 114B (and optionally its third circumferential cutline 111) and also bisects a second tooth 114B (and optionally its respective third circumferential cutline 111) of an adjacently disposed intermediate article retention structure RT2.

The embodiment of FIG. 1 comprises a single second tooth 14B having a first tooth 14A disposed on opposing sides thereof at a single location about the perimeter of the article receiving aperture AP. The embodiment of FIG. 3 comprises a single second tooth 114B having a first tooth 114A disposed on opposing sides thereof at a plurality of locations about the perimeter of the article receiving aperture AP, specifically, but not limited to three locations. The second teeth 14B, 114B have a lower fold resistance than the first teeth 14A, 114A.

The embodiment of FIG. 3 comprises a single first tooth 114A having a second tooth 114B disposed on opposing sides thereof at least one location about the perimeter of the article receiving aperture AP. The illustrated embodiment comprises a single first tooth 114A having a second tooth 114B disposed on opposing sides thereof at two locations about the perimeter of the article receiving aperture AP.

In the embodiments of both FIGS. 1 and 3 the intermediate article retention structures RT2 comprise at least one second tooth 14B, 114B about an inner portion, or inwardly facing section of the perimeter of the article receiving aperture AP. The at least one second tooth 14B, 114B about the inner portion opposes at least one second tooth 14B, 114B about an outer portion, or outwardly facing section of the perimeter of the article receiving aperture AP.

The intermediate article retention structures RT2 of the embodiments of both FIGS. 1 and 3 comprise at least one first tooth 14A, 114A (also referred to herein as an inner tooth 14A, 114A) about an inner portion, or inwardly facing section of the perimeter of the article receiving aperture AP, the at least one first tooth 14A, 114A opposes at least one second tooth 14B, 114B (also referred to herein as an outer tooth 14B, 114B) about an outer portion, or outwardly facing section of the perimeter of the article receiving aperture AP. The inner tooth 14A, 114 is disposed in closer proximity to an adjacently disposed article retention structure RT1, RT2 than the outer tooth 14B, 114B.

FIG. 3 illustrates fifth and sixth notional lines N5, N6, fifth and sixth notional lines N5, N6 extend radially from the center of the article receiving aperture AP through first radial cutlines 115A defining the outermost second teeth 114B about the fifth arc or sector. Neither of the fifth and sixth notional lines N5, N6 passes through, or intersects with, the article receiving aperture AP of an adjacently disposed article retention structure RT1, RT2. In this way the second teeth 114B disposed about the fifth arc face substantially away from the article receiving aperture AP of an adjacently disposed article retention structure RT1, RT2.

Each of the second teeth 114B disposed about the fifth arc can be considered to face substantially toward the proximal free side edge of the main panel 112.

Figure 4:
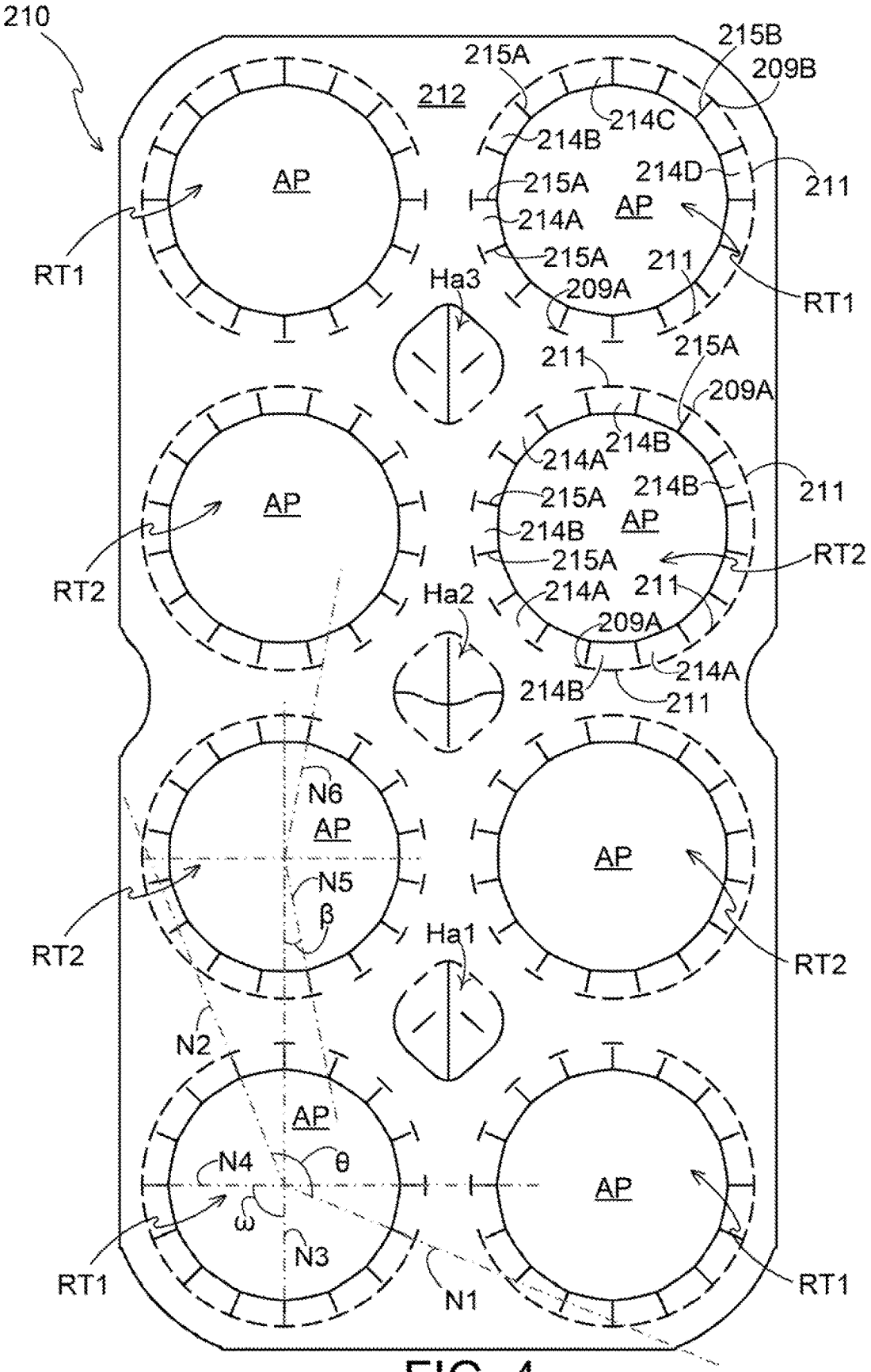
FIG. 4 is a plan view from above of a blank for forming an article carrier according to a third embodiment.

FIG. 4 illustrates a third embodiment and shows a blank 210 for forming an article carrier (not shown).

The blank 210 comprises an engaging panel 212. The engaging panel 212 of the blank 210 includes at least one article retention structure RT1, RT2, each retention structure RT1, RT2 provides an article receiving aperture AP for receiving a respective article. The engaging panel 212 comprises a plurality of article retention structures RT1, RT2, specifically eight article retention structures RT1, RT2 arranged in 2×4 matrix or array. Each of the article retention structures RT1, RT2 comprises an opening or aperture AP about which a plurality of teeth or tabs 214A, 214B, 214C, 214D may be disposed. Each of the teeth 214A, 214B, 214C, 214D is struck from the engaging panel 212 and is hingedly connected thereto. Each tooth 214A, 214B, 214C, 214D may be defined, in part, by a pair of cut lines 215A, 215B. The cut lines 215A, 215B extend radially outward from a center of the article receiving aperture AP1, AP2. The teeth or tabs 214A, 214B, 214C, 214D are arranged in an annular series about the article receiving aperture AP to form part of an article receiving opening.

The plurality of teeth 214A, 214B, 214C, 214D are provided by the main panel 212. Each of the teeth 214A, 214B, 214C, 214D is hingedly connected to the main panel 212, by a hinged connection. The hinged connection may be defined by a plurality of cut lines 209A, 209B, 211.

The plurality of cut lines 209A, 209B, 211 may be arranged as an annular series of cuts about the article receiving aperture AP.

The plurality of cut lines 209A, 209B, 211 may define or approximate a portion of circle.

The blank 210 comprises four endmost article retention structures RT1 each comprising an article receiving aperture AP. The blank 210 comprises four medial or intermediate article retention structures RT2 each comprising an article receiving aperture AP.

The endmost article retention structures RT1 comprise an article receiving opening defined in part by the article receiving aperture AP which is defined in, or struck from, the main panel 212.

The intermediate article retention structures RT2 comprise an article receiving opening defined in part by the article receiving aperture AP which is defined in, or struck from, the main panel 212.

The endmost article retention structures RT1 are substantially the same in construction as the endmost article retention structures RT1 described in the previous embodiments and/or as illustrated in FIGS. 1 and 3.

The intermediate article retention structures RT2 comprise a second plurality of teeth or tabs 214A, 214B disposed about the article receiving aperture AP. Each of the second plurality of teeth 214A, 214B comprises an engaging edge opposing a hinged edge. The engaging edges are defined by a portion of a cut line defining the article receiving aperture AP, said portion of the cut line defining the article receiving aperture AP may be linear. Each engaging edge may define a part of a polygon. The illustrated embodiment comprises sixteen teeth 214A, 214B together defining a substantial portion of hexadecagon. The intermediate article retention structures RT2 comprise seven first teeth 214A and nine second teeth 214B. Each of the first and second teeth 214A, 214B may occupy substantially the same circumferential region or portion of the article receiving aperture AP. Each tooth 214A, 214B comprises a pair of side edges, the side edges are defined by cuts 215A extending radially outward from respective vertices of the hexadecagon forming the article receiving aperture AP, that is to say, from a respective vertex between a pair of adjacent linear portions of the cut defining the portion of a hexadecagon. The cuts 215A are divergently arranged with respect to each other and define an angle therebetween, the angle may be about 22.5°.

The intermediate article retention structures RT2 comprise a plurality of first teeth 214A extending about, or occupying, a first arc. The first arc defines a respective sector which subtends a first angle. The first angle may be about 157.5° or equivalent to seven teeth 214A, 214B. Each first tooth 214A comprises, or is defined by, a pair of first radial cutlines 215A and a pair of first circumferential cutlines 209A.

The intermediate article retention structures RT2 comprise a plurality of second teeth 214B extending about, or occupying, a second arc. The second arc defines a second sector which subtends a second angle. The second angle may be about 202.5° or equivalent to nine teeth 214A, 214B. Each second tooth 214B comprises, or is defined by, a pair of first radial cutlines 215A, a pair of first circumferential cutlines 209A, and at least one third circumferential cutline 211. A notional line N3 extending longitudinally of the main panel 212 bisects the outermost second teeth 214B of the plurality of second teeth 214B. The outermost second teeth 214B are disposed adjacent to a respective first tooth 214B. The outermost second teeth 214B are disposed in closest proximity to an adjacently disposed article retention structure RT1, RT2 in the same column of article retention structures RT1, RT2. A first one of the outermost second teeth 214B is diametrically opposed to a second one of the outermost second teeth 214B.

Figure 5:
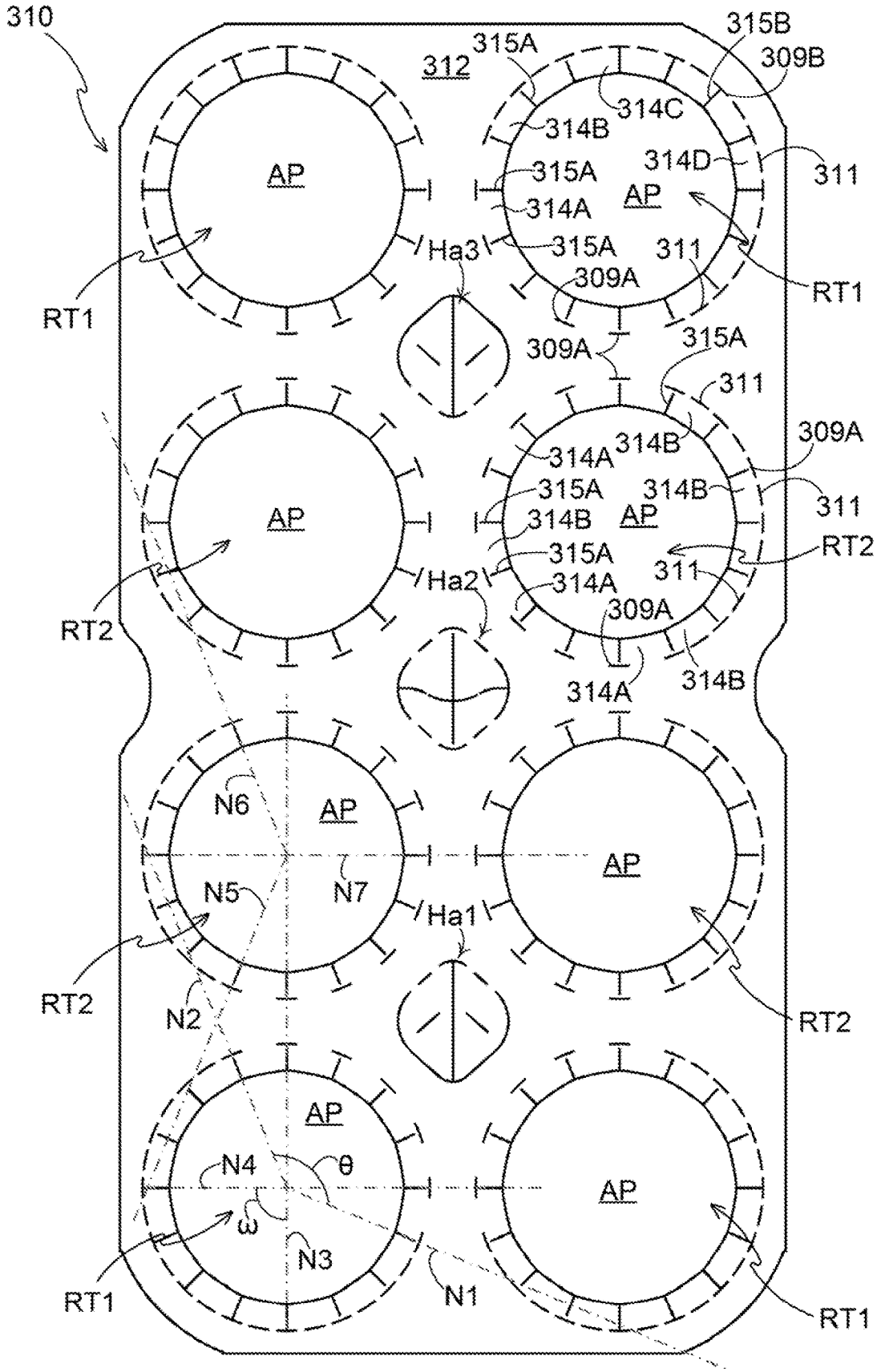
FIG. 5 is a plan view from above of a blank for forming an article carrier according to a fourth embodiment.

FIG. 5 illustrates a fourth embodiment and shows a blank 310 for forming an article carrier (not shown).

The blank 310 comprises an engaging panel 312. The engaging panel 312 of the blank 310 includes at least one article retention structure RT1, RT2, each retention structure RT1, RT2 provides an article receiving aperture AP for receiving a respective article. The engaging panel 312 comprises a plurality of article retention structures RT1, RT2, specifically eight article retention structures RT1, RT2 arranged in 2×4 matrix or array. Each of the article retention structures RT1, RT2 comprises an opening or aperture AP about which a plurality of teeth or tabs 314A, 314B, 314C, 314D may be disposed. Each of the teeth 314A, 314B, 314C, 314D is struck from the engaging panel 312 and is hingedly connected thereto. Each tooth 314A, 314B, 314C, 314D may be defined, in part, by a pair of cut lines 315A, 315B. The cut lines 315A, 315B extend radially outward from a center of the article receiving aperture AP1, AP2. The teeth or tabs 314A, 314B, 314C, 314D are arranged in an annular series about the article receiving aperture AP to form part of an article receiving opening.

The blank 310 comprises four endmost article retention structures RT1 each comprising an article receiving aperture AP. The blank 310 comprises four medial or intermediate article retention structures RT2 each comprising an article receiving aperture AP.

The endmost article retention structures RT1 comprise an article receiving opening defined in part by the article receiving aperture AP which is defined in, or struck from, the main panel 312.

The intermediate article retention structures RT2 comprise an article receiving opening defined in part by the article receiving aperture AP which is defined in, or struck from, the main panel 312.

The endmost article retention structures RT1 are substantially the same in construction as the endmost article retention structures RT1 described in the previous embodiments and/or as illustrated in FIGS. 1, 3 and 4.

The intermediate article retention structures RT2 comprise a second plurality of teeth or tabs 314A, 314B disposed about the article receiving aperture AP. Each of the second plurality of teeth 314A, 314B comprises an engaging edge opposing a hinged edge. The engaging edges are defined by a portion of a cut line defining the article receiving aperture AP, said portion of the cut line defining the article receiving aperture AP may be linear. Each engaging edge may define a part of a polygon. The illustrated embodiment comprises sixteen teeth 314A, 314B together defining a substantial portion of hexadecagon. The intermediate article retention structures RT2 comprise six first teeth 314A and ten second teeth 314B. Each of the first and second teeth 314A, 314B may occupy substantially the same circumferential region or portion of the article receiving aperture AP. Each tooth 314A, 314B comprises a pair of side edges, the side edges are defined by cuts 315A extending radially outward from respective vertices of the hexadecagon forming the article receiving aperture AP, that is to say, from a respective vertex between a pair of adjacent linear portions of the cut defining the portion of a hexadecagon. The cuts 315A are divergently arranged with respect to each other and define an angle therebetween, the angle may be about 22.5°.

The intermediate article retention structures RT2 comprise a plurality of first teeth 314A extending about, or occupying, a first arc. The first arc defines a sector which subtends a first angle. The first angle may be about 225° or equivalent to ten teeth 314A, 314B. Each first tooth 314A comprises, or is defined by, a pair of first radial cutlines 315A and a pair of first circumferential cutlines 309A.

The intermediate article retention structures RT2 comprise a plurality of second teeth 314B extending about, or occupying, a second arc. The second arc defines a second sector which subtends a second angle. The second angle may be 135° or equivalent to six about teeth 314A, 314B. Each second tooth 314B comprises, or is defined by, a pair of first radial cutlines 315A, a pair of first circumferential cutlines 309A, and at least one third circumferential cutline 311.

The intermediate article retention structures RT2 are oriented such that a notional line N3 extending longitudinally of the main panel 312 and coincident or collinear with radial cutlines 315A, 315B of the endmost article retention structures RT1 is also coincident or collinear with radial cutlines 315A of the intermediate article retention structures RT2. The notional line N3 is substantially parallel to the side edge of the main panel 312 and perpendicular to the end edge of the main panel 312. In this way a first circumferential cutline 309A of a first article retention structure RT1, RT2 is aligned with a first circumferential cutline 309A of a second, adjacent, article retention structure RT1, RT2 and defines the closest proximity of the first article retention structure RT1, RT2 to the second, adjacent, article retention structure RT1, RT2.

The intermediate article retention structures RT2 are oriented such that a notional line N7 extending transversely of the main panel 312 and coincident or collinear with radial cutlines 315A of a first intermediate article retention structure RT1 in a first column is also coincident or collinear with radial cutlines 315A of an intermediate article retention structure RT2 in a second, adjacent, column. The notional line N7 is substantially parallel to the end edge of the main panel 312 and perpendicular to the side edge of the main panel 312. In this way a first circumferential cutline 309A of the first intermediate article retention structure RT1 is aligned with a first circumferential cutline 309A of the second intermediate article retention structure RT2 and defines the closest proximity of the first intermediate article retention structure RT2 to the second intermediate article retention structure RT2.

Figure 6:
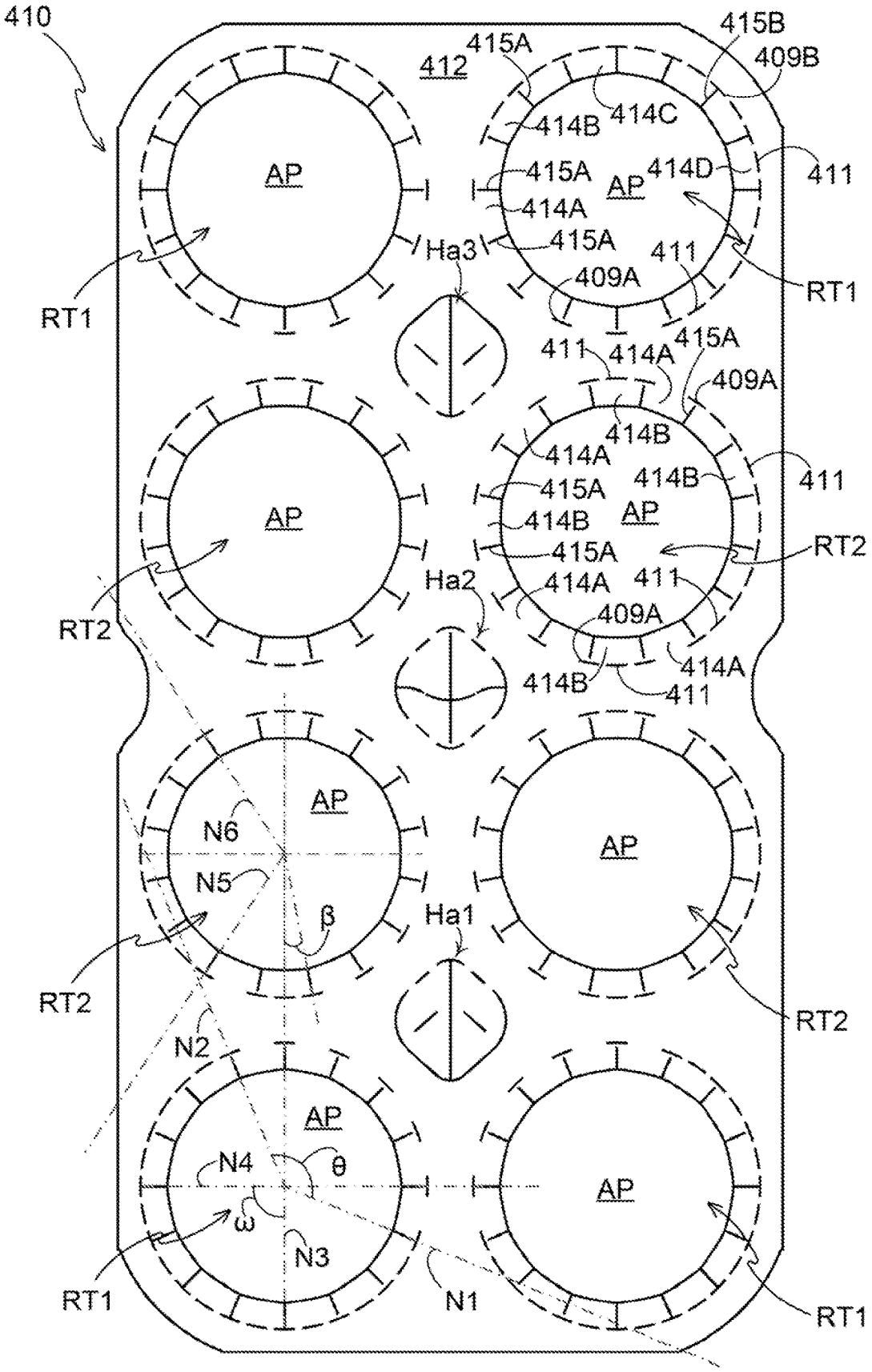
FIG. 6 is a plan view from above of a blank for forming an article carrier according to a fifth embodiment.

FIG. 6 illustrates a fifth embodiment and shows a blank 410 for forming an article carrier (not shown).

The blank 410 comprises an engaging panel 412. The engaging panel 412 of the blank 410 includes at least one article retention structure RT1, RT2, each retention structure RT1, RT2 provides an article receiving aperture AP for receiving a respective article. The engaging panel 412 comprises a plurality of article retention structures RT1, RT2, specifically eight article retention structures RT1, RT2 arranged in 2×4 matrix or array. Each of the article retention structures RT1, RT2 comprises an opening or aperture AP about which a plurality of teeth or tabs 414A, 414B, 414C, 414D may be disposed. Each of the teeth 414A, 414B, 414C, 414D is struck from the engaging panel 412 and is hingedly connected thereto. Each tooth 414A, 414B, 414C, 414D may be defined, in part, by a pair of cut lines 415A, 415B. The cut lines 415A, 415B extend radially outward from a center of the article receiving aperture AP1, AP2. The teeth or tabs 414A, 414B, 414C, 414D are arranged in an annular series about the article receiving aperture AP to form part of an article receiving opening.

The plurality of teeth 414A, 414B, 414C, 414D are provided by the main panel 412. Each of the teeth 414A, 414B, 414C, 414D is hingedly connected to the main panel 412, by a hinged connection. The hinged connection may be defined by a plurality of cut lines 409A, 409B, 411. The plurality of cut lines 409A, 409B, 411 may be arranged as an annular series of cuts about the article receiving aperture AP.

The plurality of cut lines 409A, 409B, 411 may define or approximate a portion of circle.

The blank 410 comprises four endmost article retention structures RT1 each comprising an article receiving aperture AP. The blank 410 comprises four medial or intermediate article retention structures RT2 each comprising an article receiving aperture AP.

The endmost article retention structures RT1 comprise an article receiving opening defined in part by the article receiving aperture AP which is defined in, or struck from, the main panel 412.

The intermediate article retention structures RT2 comprise an article receiving opening defined in part by the article receiving aperture AP which is defined in, or struck from, the main panel 412.

The endmost article retention structures RT1 are substantially the same in construction as the endmost article retention structures RT1 described in the previous embodiments and/or as illustrated in FIGS. 1, 3, 4, and 5.

The intermediate article retention structures RT2 comprise a second plurality of teeth or tabs 414A, 414B disposed about the article receiving aperture AP. Each of the second plurality of teeth 414A, 414B comprises an engaging edge opposing a hinged edge. The engaging edges are defined by a portion of a cut line defining the article receiving aperture AP, said portion of the cut line defining the article receiving aperture AP may be linear. Each engaging edge may define a part of a polygon. The illustrated embodiment comprises sixteen teeth 414A, 414B together defining a substantial portion of hexadecagon. The intermediate article retention structures RT2 comprise nine first teeth 414A and seven second teeth 414B. Each of the first and second teeth 414A, 414B may occupy substantially the same circumferential region or portion of the article receiving aperture AP. Each tooth 414A, 414B comprises a pair of side edges, the side edges are defined by cuts 415A extending radially outward from respective vertices of the hexadecagon forming the article receiving aperture AP, that is to say, from a respective vertex between a pair of adjacent linear portions of the cut defining the portion of a hexadecagon. The cuts 415A are divergently arranged with respect to each other and define an angle therebetween, the angle may be about 22.5°.

The intermediate article retention structures RT2 comprise a plurality of first circumferential cut lines 409A. Each of the plurality of first circumferential cut lines 409A is aligned with one of a first radial cut lines 415A such that said one of the first radial cut lines 415A or a notional extension thereof bisects a respective one of the plurality of first circumferential cut lines 409A.

Each of the radial cut lines 415A is spaced apart from a corresponding one of the plurality of first circumferential cut lines 409A. Each first radial cut line 415A is arranged with respect to one of the plurality of first circumferential cut lines 409A so as to bisect first circumferential cut lines 409A. In this way a connecting nick or bridge portion is provided between a pair of adjacently disposed teeth 414A, 414B sharing a common first radial cut line 415A. The first radial cut lines 415A and first circumferential cut lines 409A define disconnected T-shaped cuts.

The intermediate article retention structures RT2 comprise a plurality of third circumferential cut lines 411. Each of the plurality of third circumferential cut lines 411 is disposed between a pair of first circumferential cut lines 409A and is spaced apart therefrom so as to define a pair of connecting nick or bridge portions between each second tooth 414B, and the main panel 412. The pair of connecting nick or bridge portions provide a hinged or foldable connection between each second tooth 414B and the main panel 412.

The intermediate article retention structures RT2 comprise a plurality of first teeth 414A arranged in three discrete groups each extending about, or occupying, first, second, and third arcs respectively. The first and third arcs define a respective sector which subtends a first angle. The first angle may be about 22.5° or equivalent to one tooth 414A, 414B. The second arc defines a sector which subtends a second angle. The second angle may be about 157.5° or equivalent to seven teeth 414A, 414B. Each first tooth 414A comprises, or is defined by, a pair of first radial cutlines 415A and a pair of first circumferential cutlines 409A. The first and third arcs are opposed to each other.

The intermediate article retention structures RT2 comprise a plurality of second teeth 414B arranged in three discrete groups each extending about, or occupying, fourth, fifth, and sixth arcs respectively. The fourth arc defines a fourth sector which subtends a third angle. The third angle may be about 112.5° or equivalent to five teeth 414A, 414B. The fifth and sixth arcs define a respective sector each of which subtends a fourth angle. The fourth angle may be about 22.5° or equivalent to one tooth 414A, 414B. Each second tooth 414B comprises, or is defined by, a pair of first radial cutlines 415A, a pair of first circumferential cutlines 409A, and at least one third circumferential cutline 411. The fourth arc or sector may be arranged generally orthogonally to the fifth and sixth arcs or sectors and opposite the second sector or arc.

The fourth arc or sector is defined by notional line N5, N6. Neither of the notional lines N5, N6 passes through, or intersects with, the article receiving aperture AP of an adjacently disposed article retention structure RT1, RT2.

The fifth and sixth arcs comprise a second tooth 414B which is disposed in close proximity to an adjacently disposed article retention structure RT1, RT2. The fourth arc comprise a second tooth 414B which is disposed in closest proximity to a side edge of the main panel 412.

The second tooth 414B of the fifth and sixth arcs comprises a third circumferential cut line 411. The third circumferential cut line 411 is aligned to be opposite a third circumferential cut line 411 of an adjacently disposed intermediate article retention structure RT2 or a first circumferential cut line 409A of an adjacently disposed endmost article retention structure RT1.

The embodiment of FIG. 6 comprises a single second tooth 414B having a first tooth 414A disposed on opposing sides thereof at a plurality of locations about the perimeter of the article receiving aperture AP, specifically, but not limited to two locations. The second teeth 414B have a lower fold resistance than the first teeth 414A.

The embodiment of FIG. 6 comprises a single first tooth 414A having a second tooth 414B disposed on opposing sides thereof at least one location about the perimeter of the article receiving aperture AP. The illustrated embodiment comprises a single first tooth 414A having a second tooth 414B disposed on opposing sides thereof at two locations about the perimeter of the article receiving aperture AP.

Figure 7:
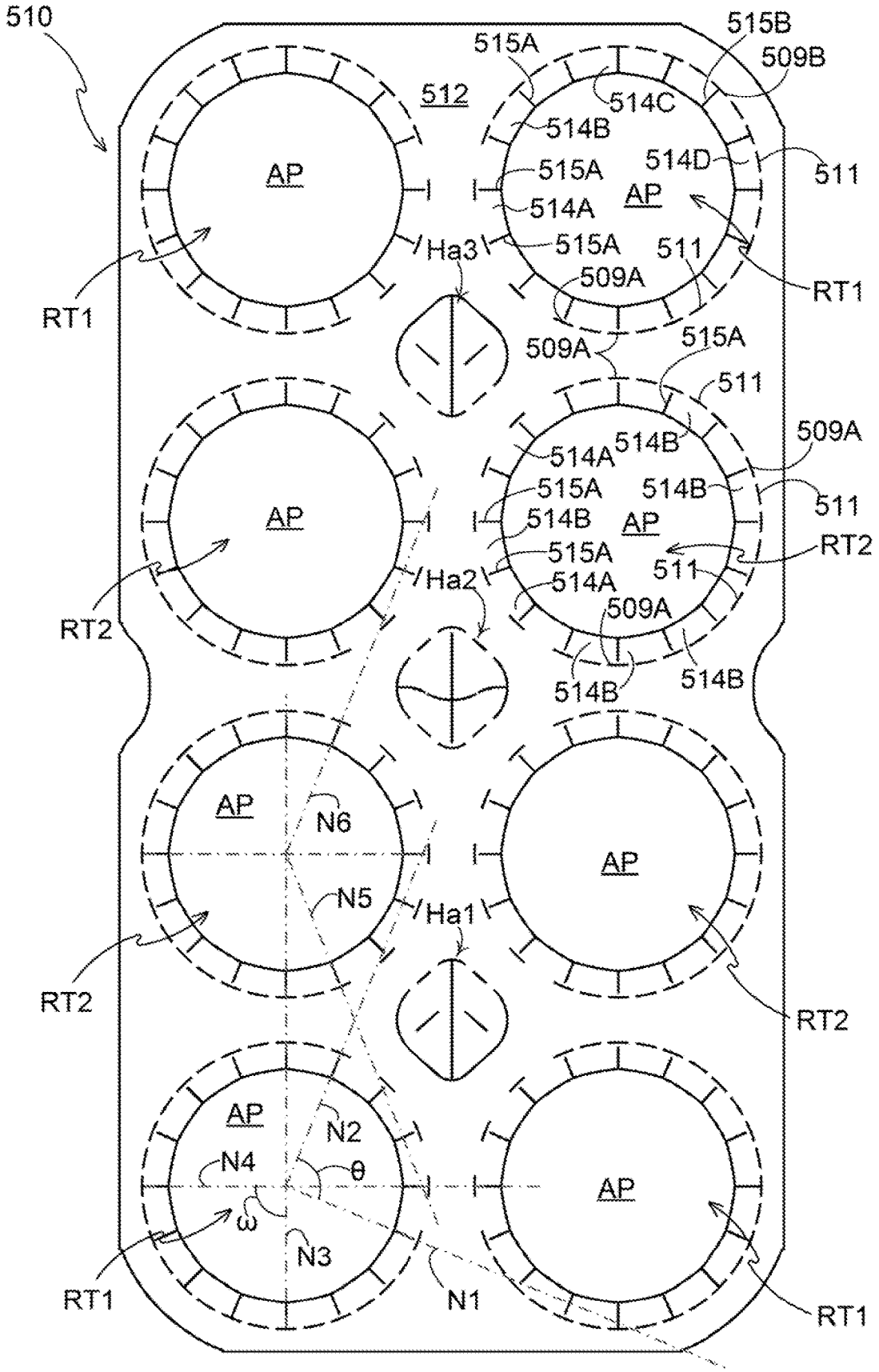
FIG. 7 is a plan view from above of a blank for forming an article carrier according to a sixth embodiment.

FIG. 7 illustrates a sixth embodiment and shows a blank 510 for forming an article carrier (not shown).

The blank 510 comprises an engaging panel 512. The engaging panel 512 of the blank 510 includes at least one article retention structure RT1, RT2, each retention structure RT1, RT2 provides an article receiving aperture AP for receiving a respective article. The engaging panel 512 comprises a plurality of article retention structures RT1, RT2, specifically eight article retention structures RT1, RT2 arranged in 2×4 matrix or array. Each of the article retention structures RT1, RT2 comprises an opening or aperture AP about which a plurality of teeth or tabs 514A, 514B, 514C, 514D may be disposed. Each of the teeth 514A, 514B, 514C, 514D is struck from the engaging panel 512 and is hingedly connected thereto. Each tooth 514A, 514B, 514C, 514D may be defined, in part, by a pair of cut lines 515A, 515B. The cut lines 515A, 515B extend radially outward from a center of the article receiving aperture AP1, AP2. The teeth or tabs 514A, 514B, 514C, 514D are arranged in an annular series about the article receiving aperture AP to form part of an article receiving opening.

The blank 510 comprises four endmost article retention structures RT1 each comprising an article receiving aperture AP. The blank 510 comprises four medial or intermediate article retention structures RT2 each comprising an article receiving aperture AP.

The endmost article retention structures RT1 comprise an article receiving opening defined in part by the article receiving aperture AP which is defined in, or struck from, the main panel 512.

The intermediate article retention structures RT2 comprise an article receiving opening defined in part by the article receiving aperture AP which is defined in, or struck from, the main panel 512.

The endmost article retention structures RT1 comprise a first plurality of teeth or tabs 514A, 514B, 514C, 514D disposed about the article receiving aperture AP. Each of the first plurality of teeth 514A, 514B, 514C, 514D comprises an engaging edge opposing a hinged edge. The engaging edges are defined by a portion of a cut line defining the article receiving aperture AP, said portion of the cut line defining the article receiving aperture AP may be linear. Each engaging edge may define a part of a polygon. The illustrated embodiment comprises sixteen teeth 514A, 514B, 514C, 514D together defining a substantial portion of hexadecagon. The endmost article retention structures RT1 comprise four first teeth 514A, six second teeth 514B, two third teeth 514C, and four fourth teeth 514D. Each of the first, second, third, and fourth teeth 514A, 514B, 514C, 514D may occupy substantially the same circumferential region or portion of the article receiving aperture AP. Each tooth 514A, 514B, 514C, 514D comprises a pair of side edges, the side edges are defined by cuts 515A, 515B extending radially outward from respective vertices of the hexadecagon forming the article receiving aperture AP, that is to say, from a respective vertex between a pair of adjacent linear portions of the cut defining the portion of a hexadecagon. The cuts 515A, 515B are divergently arranged with respect to each other and define an angle therebetween, the angle may be about 22.5°. Each tooth 514A, 514B, 514C, 514D disposed about the article receiving aperture AP has the same angular width as the other teeth 514A, 514B, 514C, 514D; the engaging edges of the teeth 514A, 514B, 514C, 514D are of equal length.

The endmost article retention structures RT1 differ from those described in the previous embodiments and/or as illustrated in FIGS. 1, 3, 4, 5 and 6 by the replacement of two first teeth 514A with two second teeth 514B, specifically the two first teeth 514A located in closest proximity to the intermediate article retention structures RT2 in the same column of article retention structures RT1, RT2 that is disposed adjacent to the endmost article retention structures RT1.

The endmost article retention structures RT1 comprise a plurality of first teeth 514A extending about or occupying a first arc, defined by notional lines N1, N2. The first arc defines a sector which subtends a first angle θ. The first angle θ may be about 90° or equivalent to four teeth 514A, 514B, 514C, 514D. Each first tooth 514A comprises, or is defined by, a pair of first radial cutlines 515A and a pair of first circumferential cutlines 509A. The first sector is defined by, between, a first notional line N1 and a second notional line N2, neither of the first and second notional lines N1, N2 passes through the article receiving aperture AP of the adjacently disposed article retention structures RT1, RT2. That is say the first notional line N1 does not pass through or intersect the article receiving aperture AP of the adjacently disposed endmost article retention structure RT1. The second notional line N2 does not pass through or intersect the article receiving aperture AP of the adjacently disposed intermediate article retention structure RT2.

The intermediate article retention structures RT2 comprise a second plurality of teeth or tabs 514A, 514B disposed about the article receiving aperture AP. Each of the second plurality of teeth 514A, 514B comprises an engaging edge opposing a hinged edge. The engaging edges are defined by a portion of a cut line defining the article receiving aperture AP, said portion of the cut line defining the article receiving aperture AP may be linear. Each engaging edge may define a part of a polygon. The illustrated embodiment comprises sixteen teeth 514A, 514B together defining a substantial portion of hexadecagon. The intermediate article retention structures RT2 comprise ten first teeth 514A and six second teeth 514B. Each of the first and second teeth 514A, 514B may occupy substantially the same circumferential region or portion of the article receiving aperture AP. Each tooth 514A, 514B comprises a pair of side edges, the side edges are defined by cuts 515A extending radially outward from respective vertices of the hexadecagon forming the article receiving aperture AP, that is to say, from a respective vertex between a pair of adjacent linear portions of the cut defining the portion of a hexadecagon. The cuts 515A are divergently arranged with respect to each other and define an angle therebetween, the angle may be about 22.5°.

The intermediate article retention structures RT2 comprise a plurality of first teeth 514A extending about, or occupying, a first arc. The first arc defines a sector which subtends a first angle. The first angle may be about 135° or equivalent to six teeth 514A, 514B. Each first tooth 514A comprises, or is defined by, a pair of first radial cutlines 515A and a pair of first circumferential cutlines 509A.

The intermediate article retention structures RT2 comprise a plurality of second teeth 514B extending about, or occupying, a second arc. The second arc defines a second sector which subtends a second angle. The second angle may be about 225° or equivalent to ten teeth 514A, 514B. Each second tooth 514B comprises, or is defined by, a pair of first radial cutlines 515A, a pair of first circumferential cutlines 509A, and at least one third circumferential cutline 511.

The intermediate article retention structures RT2 are oriented such that a notional line N3 extending longitudinally of the main panel 512 and coincident or collinear with radial cutlines 515A, 515B of the endmost article retention structures RT1 is also coincident or collinear with radial cutlines 515A of the intermediate article retention structures RT2. The notional line N3 is substantially parallel to the side edge of the main panel 512 and perpendicular to the end edge of the main panel 512. In this way a first circumferential cutline 509A of a first article retention structure RT1, RT2 is aligned with a first circumferential cutline 509A of a second, adjacent, article retention structure RT1, RT2 and defines the closest proximity of the first article retention structure RT1, RT2 to the second, adjacent, article retention structure RT1, RT2.

The present disclosure provides a carrier 90, and a blank 10; 110; 210; 310; 410; 510 for forming the carrier 90, having a main panel 12; 112; 212; 312; 412; 512 with openings for receiving at least one article B. The main panel 12; 112; 212; 312; 412; 512 may comprise a handle structure. The openings comprise an article receiving aperture AP and an annular series of tabs 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D formed around the article receiving aperture AP. The annular series of tabs 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D comprises at least one first tab 14A; 114A; 214A; 314A; 414A having a first fold resistance and at least one second tab 14B, 14C, 14D; 114B, 114C, 114D; 214B, 214C, 214D; 314B, 314C, 314D; 414B, 414C, 414D; 514B, 514C, 514D having a second fold resistance, the second fold resistance being lower than the first fold resistance.

The at least one first tab 14A; 114A; 214A; 314A; 414A and the at least one second tab 14B, 14C, 14D; 114B, 114C, 114D; 214B, 214C, 214D; 314B, 314C, 314D; 414B, 414C, 414D; 514B, 514C, 514D each comprise an angular width, the angular width of the first tab 14A; 114A; 214A; 314A;

414A is equal to the angular width of the second tab 14B, 14C, 14D; 114B, 114C, 114D; 214B, 214C, 214D; 314B, 314C, 314D; 414B, 414C, 414D; 514B, 514C, 514D and the second tab 14B, 14C,14D; 114B, 114C,114D; 214B, 214C, 214D; 314B, 314C, 314D; 414B, 414C, 414D; 514B, 514C, 514D comprises a hinged connection to the main panel 12; 112; 212; 312; 412; 512 having a greater number, or extent, of weakening or hinge elements 9A, 9B, 11 than the hinged connection between the first tab 14A; 114A; 214A; 314A; 414A and main panel 12; 112; 212; 312; 412; 512.

The at least one first tab 14A; 114A; 214A; 314A; 414A comprises a first hinged connection to the main panel 12; 112; 212; 312; 412; 512 having at least one connecting bridge or nick. The at least one connecting bridge or nick has a first total or combined length. The at least one second tab 14B, 14C,14D; 114B, 114C,114D; 214B, 214C, 214D; 314B, 314C, 314D; 414B, 414C, 414D; 514B, 514C, 514D comprises a second hinged connection to the main panel 12; 112; 212; 312; 412; 512 having at least one connecting bridge or nick. The at least one connecting bridge or nick has a second total or combined length. The second total or combined length is less than the first total or combined length. The extent of the connecting bridges or nicks provided in the second hinged connection is less than in the first hinged connection.

The at least one first tab 14A; 114A; 214A; 314A; 414A may be an inner tooth, that is to say it is disposed about an interior region of the article receiving aperture AP.

The at least one second tab 14B, 14C, 14D; 114B, 114C, 114D; 214B, 214C, 214D; 314B, 314C, 314D; 414B, 414C, 414D; 514B, 514C, 514D may be an outer tooth, that is to say it is disposed about an exterior region of the article receiving aperture AP.

The outer tooth may be diametrically opposed to the inner tooth.

The inner tooth may be disposed in closer proximity to a second article receiving aperture AP of an adjacently disposed opening or article engaging structure RT1, RT2 than the outer tooth.

The outer tooth may be arranged such that a corner notional line N8 passes through, or defines, a side edge of said outer tooth, see, for example, FIG. 1. The corner notional line N8 passes through a corner of the main panel 12, the corner may be real or notional. The corner of the main panel 12 may be defined by a vertex or intersection of the adjacent perpendicular edges of the blank 10, or notional extensions thereof in embodiments having rounded or filleted corners.

The main panel 12; 112; 212; 312; 412; 512 may comprise a handle opening defined, at least in part, by at least one handle flap 60, 62, 64, 66, 70, 72. The at least one handle flap 60, 62, 64, 66, 70, 72 folds towards the at least one inner tooth of the article receiving opening.

The at least one handle flap 60, 62, 64, 66, 70, 72 may comprise a first handle flap 60, 62, 64, 66, 70, 72 and a second handle flap 60, 62, 64, 66, 70, 72, the first handle flap 60, 62, 64, 66, 70, 72 folds towards the at least one inner tooth of a first opening in the main panel 12; 112; 212; 312; 412; 512, the second handle flap 60, 62, 64, 66, 70, 72 folds towards at least one inner tooth of a second opening in the main panel 12; 112; 212; 312; 412; 512.

The present disclosure also provides a blank 10; 110; 210; 310; 410; 510 for forming an article carrier 90 of the top engaging type. The blank 10; 110; 210; 310; 410; 510 or article carrier 90 comprises at least one panel 12; 112; 212; 312; 412; 512 having at least one article engaging structure RT1, RT2. The at least one article engaging structure RT1, RT2 comprises an article receiving aperture AP and an annular series of teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D formed around the article receiving aperture AP.

In some embodiments, the annular series of teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D may comprise a first tooth 14B, 14C, 14D; 114B, 114C, 114D; 214B, 214C, 214D; 314B, 314C, 314D; 414B, 414C, 414D; 514B, 514C, 514D disposed between a pair of second teeth 14A; 114A; 214A; 314A; 414A. Each of the teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D of the annular series of teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D is defined, at least in part, by a pair of T-cuts. The T-cuts are defined by a radial cutline 15A, 15B and a circumferential cutline 9A, 9B. The first tooth 14B, 14C, 14D; 114B, 114C, 114D; 214B, 214C, 214D; 314B, 314C, 314D; 414B, 414C, 414D; 514B, 514C, 514D comprises a further circumferential cutline 11 disposed between a pair circumferential cutlines 9A, 9B.

In some embodiments, the annular series of teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D may comprise a second tooth 14A; 114A; 214A; 314A; 414A disposed between a pair of first teeth 14B, 14C, 14D; 114B, 114C, 114D; 214B, 214C, 214D; 314B, 314C, 314D; 414B, 414C, 414D; 514B, 514C, 514D. Each of the teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D of the annular series of teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D is defined, at least in part, by a pair of T-cuts. The T-cuts are defined by a radial cutline 15A, 15B and a circumferential cutline 9A, 9B. The pair of first teeth 14B, 14C, 14D; 114B, 114C, 114D; 214B, 214C, 214D; 314B, 314C, 314D; 414B, 414C, 414D; 514B, 514C, 514D each comprise a further circumferential cutline 11 disposed between a pair circumferential cutlines 9A, 9B.

The present disclosure also provides a blank 10; 110; 210; 310; 410; 510 for forming an article carrier 90 of the top engaging type. The blank 10; 110; 210; 310; 410; 510 or article carrier 90 comprises at least one panel 12; 112; 212; 312; 412; 512 having at least two article engaging structures RT1, RT2. Each of the at least two article engaging structures RT1, RT2 comprises an article receiving aperture AP and an annular series of teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D formed around the article receiving aperture AP. Each of the teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D of the annular series of teeth 14A, 14B, 14C,14D; 114A, 114B, 114C, 114D; 214A, 214B, 214C,214D; 314A, 314B, 314C, 314D; 414A, 414B, 414C, 414D; 514A, 514B, 514C, 514D is defined, at least in part, by a pair of T-cuts. The T-cuts are defined by a radial cutline 15A, 15B and a circumferential cutline 9A, 9B. The annular series of teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D of a first one of the at least two article engaging structures RT1, RT2 comprises a first tooth 14B, 14C,14D; 114B, 114C,114D; 214B, 214C,214D; 314B, 314C,314D; 414B, 414C,414D; 514B, 514C, 514D disposed adjacent to at least one second tooth 14A; 114A; 214A; 314A; 414A. The annular series of teeth 14A, 14B, 14C, 14D; 114A, 114B, 114C, 114D; 214A, 214B, 214C, 214D; 314A, 314B, 314C, 314D; 414A, 414B, 414C, 414D; 514A, 514B, 514C, 514D of a second one of the at least two article engaging structures RT1, RT2 comprises a first tooth 14B, 14C, 14D; 114B, 114C, 114D; 214B, 214C, 214D; 314B, 314C, 314D; 414B, 414C, 414D; 514B, 514C, 514D disposed adjacent to at least one second tooth 14A; 114A; 214A; 314A; 414A. The first teeth 14B, 14C, 14D; 114B, 114C, 114D; 214B, 214C, 214D; 314B, 314C, 314D; 414B, 414C, 414D; 514B, 514C, 514D comprise a further circumferential cutline 11 disposed between a pair circumferential cutlines 9A, 9B. The first tooth 14B, 14C, 14D; 114B, 114C, 114D; 214B, 214C, 214D; 314B, 314C, 314D; 414B, 414C, 414D; 514B, 514C, 514D of the first one of the at least two article engaging structures RT1, RT2 is bisected by a notional line passing through the center of the article receiving aperture AP of the first one of the at least two article engaging structures RT1, RT2. The notional line passes through the center of the article receiving aperture AP of the second one of the at least two article engaging structures RT1, RT2 and bisects the first tooth 14B, 14C, 14D; 114B, 114C, 114D; 214B, 214C, 214D; 314B, 314C, 314D; 414B, 414C, 414D; 514B, 514C, 514D of the second one of the at least two article engaging structures RT1, RT2.

The engaging panel 12; 112; 212; 312; 412; 512 may comprise a handle opening defined, at least in part, by at least two handle flaps 60, 62, 64, 66, 70, 72. A first one of the at least two handle flaps 60, 62, 64, 66, 70, 72 folds towards the at least one second tooth 14A; 114A; 214A; 314A; 414A of the first one of the at least two article engaging structures RT1, RT2. A second one of the at least two handle flaps 60, 62, 64, 66, 70, 72 folds towards the at least one second tooth 14A; 114A; 214A; 314A; 414A of the second one of the at least two article engaging structures RT1, RT2. The first handle flap being hingedly connected to the engaging panel 12; 112; 212; 312; 412; 512 by a first fold line and the first handle flap being hingedly connected to the engaging panel 12; 112; 212; 312; 412; 512 by a second fold line. The first fold line being divergently arranged with respect to the second fold line.

The present disclosure also provides a blank 10; 110; 210; 310; 410; 510 for forming an article carrier 90 of the top engaging type. The blank 10; 110; 210; 310; 410; 510 or article carrier 90 comprises an engaging panel 112; 212; 412 having at least two article engaging structures RT1, RT2. Each of the at least two article engaging structures RT1, RT2 comprises an article receiving aperture AP and an annular series of teeth 114A, 114B, 114C, 114D; 214A, 214B, 214C, 214D; 414A, 414B, 414C, 414D formed around the article receiving aperture AP. Each of the teeth 114A, 114B, 114C, 114D; 214A, 214B, 214C, 214D; 414A, 414B, 414C, 414D of the annular series of teeth 114A, 114B, 114C, 114D; 214A, 214B, 214C, 214D; 414A, 414B, 414C, 414D is defined, at least in part, by a pair of T-cuts. The T-cuts comprise a radial cutline 115A, 115B and a circumferential cutline 109A, 109B. The annular series of teeth 114A, 114B, 114C, 114D; 214A, 214B, 214C, 214D; 414A, 414B, 414C, 414D of a first one of the at least two article engaging structures RT1, RT2 comprises a pair of first teeth 114A; 214A; 414A separated by a T-cut. The annular series of teeth 114A, 114B, 114C, 114D; 214A, 214B, 214C, 214D; 414A, 414B, 414C, 414D of a second one of the at least two article engaging structures RT1, RT2 comprises at least one second tooth 114B, 114C, 114D; 214B, 214C, 214D; 414B, 414C, 414D. The at least one second tooth 114B, 114C, 114D; 214B, 214C, 214D; 414B, 414C, 414D comprises a further circumferential cutline 111 disposed between a pair circumferential cutlines 109A, 109B. The further circumferential cutline 111 is disposed opposite the T-cut separating the pair of first teeth 114A; 214A; 414A. A notional line passing through the center of the article receiving aperture AP of the first one of the at least two article engaging structures RT1, RT2 and the center of the article receiving aperture AP of the second one of the at least two article engaging structures RT1, RT2 bisects at least one second tooth 114B, 114C, 114D; 214B, 214C, 214D; 414B, 414C, 414D and/or the further circumferential cutline 111. The notional line is coincident or collinear with a radial portion 115A of the T-cut and may bisect a circumferential portion 109A of the T-cut.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier for packaging at least one article, the article carrier comprising a main panel with openings for receiving at least one article, the openings comprising an article receiving aperture and an annular series of tabs formed around the article receiving aperture, wherein the annular series of tabs comprises at least one first tab of the annular series of tabs having a first folding resistance and at least one second tab of the annular series of tabs having a second folding resistance, the second folding resistance being lower than the first folding resistance.

2. An article carrier according to claim 1 wherein the at least one first tab and the at least one second tab each comprise an angular width, the angular width of the at least one first tab is equal to the angular width of the at least one second tab and the at least one second tab comprises a hinged connection to the main panel having a greater number of weakening elements than a hinged connection between the at least one first tab and the main panel.

3. An article carrier according to claim 1 wherein the at least one first tab comprises a first hinged connection to the main panel having at least one first connecting bridge, the at least one first connecting bridge having a first total length, the at least one second tab comprises a second hinged connection to the main panel having at least one second connecting bridge, the at least one second connecting bridge has a second total length, the second total length is less than the first total length.

4. An article carrier according to claim 3 wherein the second hinged connection to the main panel comprises a plurality of second connecting bridges, the plurality of second connecting bridges has a combined second length, the combined second length is less than the first total length.

5. An article carrier according to claim 1 wherein the at least one first tab is an inner tooth, disposed about an interior region of the article receiving aperture.

6. An article carrier according to claim 5 wherein the at least one second tab is an outer tooth, disposed about an exterior region of the article receiving aperture.

7. An article carrier according to claim 6 wherein the outer tooth is diametrically opposed to the inner tooth.

8. An article carrier according to claim 7 wherein the inner tooth is disposed in closer proximity to a second article receiving aperture of an adjacently disposed opening or article engaging structure than the outer tooth.

9. An article carrier according to claim 6 wherein the outer tooth may be arranged such that a notional line passes through a center of the opening and a vertex defined by adjacent side and end edges of the main panel is collinear with a side edge of the outer tooth.

10. An article carrier according to claim 1 wherein the main panel comprises a handle opening defined, at least in part, by at least one handle flap hingedly connected to the main panel, the at least one handle flap arranged to fold towards the at least one first tab.

11. An article carrier according to claim 10 wherein the at least one handle flap comprises a first handle flap and a second handle flap hingedly connected to the main panel by respective hinged connections, the first handle flap folds towards the at least one first tab of a first opening in the main panel and the second handle flap folds towards the at least one first tab of a second opening in the main panel.

12. An article carrier according to claim 1 wherein the at least one article receiving aperture is a corner aperture, and the at least one first and second tabs are defined by radial cut lines, the radial cut line of the at least one second tab is positioned across from the respective corner of the main panel such that the radial cut line extends from the corner aperture toward the corner of the main panel.

13. A top engaging article carrier for packaging at least one article, the article carrier comprising an engaging panel having at least one article engaging structure, the at least one article engaging structure comprising an article receiving aperture and an annular series of teeth formed around the article receiving aperture, wherein the annular series of teeth comprises a first tooth disposed between a pair of second teeth, each of the teeth of the annular series of teeth is defined, at least in part, by a pair of T-cuts, the T-cuts are defined by a radial cutline and a first circumferential cutline, the first tooth comprises a second circumferential cutline disposed between an adjacent pair of first circumferential cutlines.

14. An article carrier according to claim 13, wherein the annular series of teeth further comprises a second tooth disposed between a pair of first teeth, and the pair of first teeth each comprise a second circumferential cutline disposed between a pair of first circumferential cutlines.

15. An article carrier according to claim 14, wherein the engaging panel comprises two article engaging structures, each of the two article engaging structures comprising the article receiving aperture and the annular series of teeth disposed around the article receiving aperture, wherein the annular series of teeth of a first one of the two article engaging structures comprises the first tooth disposed adjacent to the second tooth, the annular series of teeth of a second one of the two article engaging structures comprises the first tooth disposed adjacent to the second tooth, the first tooth of each of the first and second article engaging structures comprises the second circumferential cutline disposed between the pair of first circumferential cutlines, the first tooth of the first one of the two article engaging structures is bisected by a notional line passing through the center of the article receiving aperture of the first one of the two article engaging structures, and wherein the notional line passes through the center of the article receiving aperture of the second one of the two article engaging structures and bisects the first tooth of the second one of the two article engaging structures.

16. An article carrier according to claim 13, wherein the engaging panel comprises at least two article engaging structures, each of the at least two article engaging structures comprising the article receiving aperture and the annular series of teeth formed around the article receiving aperture, the annular series of teeth of a first one of the at least two article engaging structures comprises a pair of first teeth separated by a first T-cut, the annular series of teeth of a second one of the at least two article engaging structures comprises a second tooth, the second tooth comprises a second circumferential cutline disposed between a pair of first circumferential cutlines, and wherein the second circumferential cutline of the second tooth is disposed opposite the first T-cut separating the pair of first teeth.

17. An article carrier according to claim 16 wherein a notional line passing through the center of the article receiving aperture of the first one of the at least two article engaging structures and the center of the article receiving aperture of the second one of the at least two article engaging structures bisects said second tooth and its respective second circumferential cutline, the notional line is collinear with a radial portion of the first T-cut, and bisects a first circumferential cutline of the first T-cut.

18. A blank for forming an article carrier, the blank comprising a main panel with openings for receiving at least one article, the openings each comprising an article receiving aperture and an annular series of tabs formed around the article receiving aperture, wherein the annular series of tabs comprises at least one first tab having a first folding resistance and at least one second tab having a second folding resistance, and wherein the second folding resistance is lower than the first folding resistance.

19. A blank according to claim 18, the main panel comprising an engaging panel having a plurality of article engaging structures each comprising one of the openings comprising the article receiving aperture and the annular series of tabs as an annular series of teeth formed around the article receiving aperture, wherein the annular series of teeth comprises a first tooth disposed between a pair of second teeth, each of the teeth of the annular series of teeth is defined, at least in part, by a pair of T-cuts, the T-cuts are defined by a radial cutline and a first circumferential cutline, and wherein the first tooth comprises a second circumferential cutline disposed between an adjacent pair of first circumferential cutlines.

20. A blank according to claim 19, wherein the annular series of teeth further comprises a second tooth disposed between a pair of first teeth, and wherein the pair of first teeth each comprise a second circumferential cutline disposed between a pair of first circumferential cutlines.

21. A blank according to claim 20, wherein the engaging panel comprises two article engaging structures, each of the two article engaging structures comprising the article receiving aperture and the annular series of teeth disposed around the article receiving aperture, wherein the annular series of teeth of a first one of the two article engaging structures comprises the first tooth disposed adjacent to the second tooth, the annular series of teeth of a second one of the two article engaging structures comprises the first tooth disposed adjacent to the second tooth, the first tooth of each of the first and second article engaging structures comprises the second circumferential cutline disposed between the pair of first circumferential cutlines, the first tooth of the first one of the two article engaging structures is bisected by a notional line passing through the center of the article receiving aperture of the first one of the two article engaging structures, the notional line passes through the center of the article receiving aperture of the second one of the two article engaging structures and bisects the first tooth of the second one of the two article engaging structures.

22. A blank according to claim 19, wherein the engaging panel comprises at least two article engaging structures, each of the at least two article engaging structures comprising the article receiving aperture and the annular series of teeth formed around the article receiving aperture, wherein the annular series of teeth of a first one of the at least two article engaging structures comprises a pair of first teeth separated by a first T-cut, the annular series of teeth of a second one of the at least two article engaging structures comprises a second tooth, the second tooth comprises a second circumferential cutline disposed between a pair of first circumferential cutlines, and wherein the second circumferential cutline of the second tooth is disposed opposite the T-cut separating the pair of first teeth.

* * * * *